US011859815B2

(12) United States Patent
Al-Shaiji et al.

(10) Patent No.: US 11,859,815 B2
(45) Date of Patent: Jan. 2, 2024

(54) FLARE CONTROL AT WELL SITES

(71) Applicant: Saudi Arabian Oil Company, Dhahran (SA)

(72) Inventors: Omar Adnan Al-Shaiji, Dhahran (SA); Khalid M. Alajmi, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 49 days.

(21) Appl. No.: 17/323,632

(22) Filed: May 18, 2021

(65) Prior Publication Data

US 2022/0373176 A1 Nov. 24, 2022

(51) Int. Cl.
*F23G 7/08* (2006.01)
*E21B 41/00* (2006.01)

(52) U.S. Cl.
CPC ..... *F23G 7/085* (2013.01); *E21B 41/0071* (2013.01); *F23G 2207/102* (2013.01); *F23G 2207/30* (2013.01); *F23G 2209/14* (2013.01); *F23G 2900/55006* (2013.01)

(58) Field of Classification Search
CPC ..... F23G 7/085; F23G 2207/102; F23G 2207/30; F23G 2209/14; F23G 2900/55006; F23G 5/50; F23G 7/08; F23G 2207/10; F23G 2207/101; E21B 41/0071; E21B 2200/04; F16K 1/14; F16K 3/22; F16K 3/28; F16K 27/067; F16K 1/52; F16K 1/523; F16K 1/526; F16K 1/54; F16K 3/34; F16K 3/32; F16K 15/063; B05B 11/0062–0064
USPC ..... 431/202; 239/585.1, 585.2, 585.4
See application file for complete search history.

(56) References Cited

U.S. PATENT DOCUMENTS

| | | | |
|---|---|---|---|
| 880,404 | A | 2/1908 | Sanford |
| 1,033,655 | A | 7/1912 | Baker |
| 1,258,273 | A | 3/1918 | Titus et al. |
| 1,392,650 | A | 10/1921 | Mcmillian |
| 1,491,066 | A | 4/1924 | Patrick |
| 1,580,352 | A | 4/1926 | Ercole |
| 1,591,264 | A | 7/1926 | Baash |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

US Environmental Protection Agency, Types of Oil, Jan. 23, 2017 (Year: 2017).*

(Continued)

*Primary Examiner* — Vivek K Shirsat
(74) *Attorney, Agent, or Firm* — Fish & Richardson P.C.

(57) ABSTRACT

A system and method for flaring with a flare including a flare stack and a flare tip at a well site having a wellhead and a wellbore for production of crude oil or natural gas, or both, providing produced fluid including hydrocarbon from the wellhead to the flare stack, discharging the produced fluid from the flare tip through a nozzle discharge opening, combusting the hydrocarbon of the produced fluid as discharged from the flare tip, and a control system adjusting flow area of the nozzle discharge opening.

22 Claims, 4 Drawing Sheets

106

(56) References Cited

U.S. PATENT DOCUMENTS 1,621,947 A 3/1927 Moore
1,638,494 A 8/1927 Lewis et al.
1,789,993 A 1/1931 Switzer
1,896,236 A 2/1933 Howard
1,896,482 A 2/1933 Crowell
1,897,297 A 2/1933 Brown
1,949,498 A 3/1934 Frederick et al.
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,935,020 A 5/1960 Howard et al.
2,947,362 A 8/1960 Smith
2,965,175 A 12/1960 Ransom
2,965,177 A 12/1960 Le Bus et al.
2,965,183 A 12/1960 Le Bus et al.
3,005,506 A 10/1961 Le Bus et al.
3,023,810 A 3/1962 Anderson
3,116,799 A 1/1964 Lemons
3,147,536 A 9/1964 Lamphere
3,191,677 A 6/1965 Kinley
3,225,828 A 12/1965 Wisenbaker et al.
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,409,084 A 11/1968 Lawson, Jr. et al.
3,437,136 A 4/1969 Young
3,667,721 A 6/1972 Vujasinovic
3,747,674 A 7/1973 Murray
3,752,230 A 8/1973 Bernat et al.
3,833,337 A 9/1974 Desty et al.
3,897,038 A 7/1975 Le Rouax
3,915,426 A 10/1975 Le Rouax
3,946,553 A * 3/1976 Roberts ..... F23R 3/20 60/737
4,030,354 A 6/1977 Scott
4,039,798 A 8/1977 Lyhall et al.
4,042,019 A 8/1977 Henning
4,059,155 A 11/1977 Greer
4,099,699 A 7/1978 Allen
4,127,380 A * 11/1978 Straitz, III ..... F23G 7/085 431/15
4,190,112 A 2/1980 Davis
4,227,573 A 10/1980 Pearce et al.
4,254,983 A 3/1981 Harris
4,265,611 A 5/1981 Reed et al.
4,276,931 A 7/1981 Murray
4,285,400 A 8/1981 Mullins
4,289,200 A 9/1981 Fisher
4,296,822 A 10/1981 Ormsby
4,336,017 A 6/1982 Desty
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,431,402 A * 2/1984 Hamilton ..... E21B 41/0071 431/23
4,467,996 A 8/1984 Baugh
4,478,286 A 10/1984 Fineberg
4,505,668 A 3/1985 Dibiano et al.
4,515,212 A 5/1985 Krugh
4,538,684 A 9/1985 Sheffield
4,562,888 A 1/1986 Collet
4,603,578 A 8/1986 Stolz
4,611,658 A 9/1986 Salerni et al.
4,616,721 A 10/1986 Furse
4,696,502 A 9/1987 Desai
4,791,992 A 12/1988 Greenlee et al.
4,834,184 A 5/1989 Streich et al.
4,836,289 A 6/1989 Young
4,869,321 A 9/1989 Hamilton
4,877,085 A 10/1989 Pullig, Jr.
4,898,240 A 2/1990 Wittrisch
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,054,833 A 10/1991 Bishop et al.
5,060,737 A 10/1991 Mohn
5,117,909 A 6/1992 Wilton et al.
5,129,956 A 7/1992 Christopher et al.
5,176,208 A 1/1993 Lalande et al.
5,178,219 A 1/1993 Streich et al.
5,197,547 A 3/1993 Morgan
5,203,646 A 4/1993 Landsberger et al.
5,295,541 A 3/1994 Ng et al.
5,330,000 A 7/1994 Givens et al.
5,343,946 A 9/1994 Morrill
5,348,095 A 9/1994 Worrall
5,358,048 A 10/1994 Brooks
5,392,715 A 2/1995 Pelrine
5,456,312 A 10/1995 Lynde et al.
5,507,346 A 4/1996 Gano et al.
5,580,114 A 12/1996 Palmer
5,584,342 A 12/1996 Swinford
5,605,366 A 2/1997 Beeman
5,639,135 A 6/1997 Beeman
5,667,015 A 9/1997 Harestad et al.
5,673,754 A 10/1997 Taylor
5,678,635 A 10/1997 Dunlap et al.
5,685,982 A 11/1997 Foster
5,698,814 A 12/1997 Parsons
5,775,420 A 7/1998 Mitchell et al.
5,806,596 A 9/1998 Hardy et al.
5,833,001 A 11/1998 Song et al.
5,842,518 A 12/1998 Soybel et al.
5,881,816 A 3/1999 Wright
5,899,796 A 5/1999 Kamiyama et al.
5,924,489 A 7/1999 Hatcher
5,931,443 A 8/1999 Corte, Sr.
5,944,101 A 8/1999 Hearn
6,070,665 A 6/2000 Singleton et al.
6,112,809 A 9/2000 Angle
6,130,615 A 10/2000 Poteet
6,138,764 A 10/2000 Scarsdale et al.
6,155,428 A 12/2000 Bailey et al.
6,247,542 B1 6/2001 Kruspe et al.
6,276,452 B1 8/2001 Davis et al.
6,371,204 B1 4/2002 Singh et al.

(56) References Cited

U.S. PATENT DOCUMENTS 6,378,627 B1 4/2002 Tubel et al.
6,491,108 B1 12/2002 Slup et al.
6,510,947 B1 1/2003 Schulte et al.
6,595,289 B2 7/2003 Tumlin et al.
6,637,511 B2 10/2003 Linaker
6,679,330 B1 1/2004 Compton et al.
6,688,386 B2 2/2004 Cornelssen
6,698,712 B2 3/2004 Milberger et al.
6,729,392 B2 5/2004 DeBerry et al.
6,768,106 B2 7/2004 Gzara et al.
6,808,023 B2 10/2004 Smith et al.
6,811,032 B2 11/2004 Schulte et al.
6,854,521 B2 2/2005 Echols et al.
6,880,639 B2 4/2005 Rhodes et al.
6,899,178 B2 5/2005 Tubel
6,913,084 B2 7/2005 Boyd
7,049,272 B2 5/2006 Sinclair et al.
7,051,810 B2 5/2006 Halliburton
7,082,994 B2 8/2006 Frost, Jr. et al.
7,090,019 B2 8/2006 Barrow et al.
7,096,950 B2 8/2006 Howlett et al.
7,117,941 B1 10/2006 Gano
7,117,956 B2 10/2006 Grattan et al.
7,128,146 B2 10/2006 Baugh
7,150,328 B2 12/2006 Marketz et al.
7,174,764 B2 2/2007 Oosterling et al.
7,188,674 B2 3/2007 McGavern, III et al.
7,188,675 B2 3/2007 Reynolds
7,218,235 B1 5/2007 Rainey
7,231,975 B2 6/2007 Lavaure et al.
7,249,633 B2 7/2007 Ravensbergen et al.
7,275,591 B2 10/2007 Allen et al.
7,284,611 B2 10/2007 Reddy et al.
7,303,010 B2 12/2007 de Guzman et al.
7,354,265 B2 4/2008 Mashhour et al.
7,363,860 B2 4/2008 Wilson
7,383,889 B2 6/2008 Ring
7,398,832 B2 7/2008 Brisco
7,405,182 B2 7/2008 Verrett
7,418,860 B2 9/2008 Austerlitz et al.
7,424,909 B2 9/2008 Roberts et al.
7,488,705 B2 2/2009 Reddy et al.
7,497,260 B2 3/2009 Telfer
7,533,731 B2 5/2009 Corre
7,591,305 B2 9/2009 Brookey et al.
7,600,572 B2 10/2009 Slup et al.
7,617,876 B2 11/2009 Patel et al.
7,621,324 B2 11/2009 Atencio
7,712,527 B2 5/2010 Roddy
7,735,564 B2 6/2010 Guerrero
7,762,323 B2 7/2010 Frazier
7,762,330 B2 7/2010 Saylor, III et al.
7,802,621 B2 9/2010 Richards et al.
7,878,240 B2 2/2011 Garcia
7,934,552 B2 5/2011 La Rovere
7,946,273 B2 5/2011 Lippa et al.
7,965,175 B2 6/2011 Yamano
8,002,049 B2 8/2011 Keese et al.
8,056,621 B2 11/2011 Ring et al.
8,069,916 B2 12/2011 Giroux et al.
8,138,927 B2 3/2012 Diepenbroek et al.
8,157,007 B2 4/2012 Nicolas
8,201,693 B2 6/2012 Jan
8,210,251 B2 7/2012 Lynde et al.
8,275,538 B2 9/2012 Surnilla et al.
8,282,389 B2 10/2012 Dhulst et al.
8,376,051 B2 2/2013 McGrath et al.
8,424,611 B2 4/2013 Smith et al.
8,453,724 B2 6/2013 Zhou
8,496,055 B2 7/2013 Mootoo et al.
8,579,024 B2 11/2013 Mailand et al.
8,579,037 B2 11/2013 Jacob
8,596,463 B2 12/2013 Burkhard
8,662,182 B2 3/2014 Redlinger et al.
8,726,983 B2 5/2014 Khan
8,770,276 B1 7/2014 Nish et al.
8,899,338 B2 12/2014 Elsayed et al.
8,991,489 B2 3/2015 Redlinger et al.
9,079,222 B2 7/2015 Burnett et al.
9,109,433 B2 8/2015 DiFoggio et al.
9,133,671 B2 9/2015 Kellner
9,142,111 B2 9/2015 Fernandes et al.
9,163,469 B2 10/2015 Broussard et al.
9,181,782 B2 11/2015 Berube et al.
9,212,532 B2 12/2015 Leuchtenberg et al.
9,234,394 B2 1/2016 Wheater et al.
9,309,846 B2 * 4/2016 McAlister ..... F02M 21/026
9,335,232 B2 5/2016 Scheucher
9,353,589 B2 5/2016 Hekelaar
9,359,861 B2 6/2016 Burgos
9,366,434 B2 * 6/2016 Cody ..... F23N 3/007
9,410,066 B2 8/2016 Ghassemzadeh
9,416,617 B2 8/2016 Wiese et al.
9,441,441 B1 9/2016 Hickie
9,441,451 B2 9/2016 Jurgensmeier
9,528,354 B2 12/2016 Loiseau et al.
9,551,200 B2 1/2017 Read et al.
9,568,192 B1 * 2/2017 Archer ..... F23J 15/02
9,574,417 B2 2/2017 Laird et al.
9,617,829 B2 4/2017 Dale et al.
9,657,213 B2 5/2017 Murphy et al.
9,677,762 B2 6/2017 Tullos
9,797,519 B2 * 10/2017 Gyger ..... F16K 1/42
9,903,192 B2 2/2018 Entchev
9,976,407 B2 5/2018 Ash et al.
10,087,752 B2 10/2018 Bedonet
10,161,194 B2 12/2018 Clemens et al.
10,189,031 B2 1/2019 Funseth et al.
10,198,929 B2 2/2019 Snyder
10,266,698 B2 4/2019 Cano et al.
10,280,706 B1 5/2019 Sharp, III
10,301,898 B2 5/2019 Orban
10,301,989 B2 5/2019 Imada
10,544,640 B2 1/2020 Hekelaar et al.
10,584,546 B1 3/2020 Ford
10,626,698 B2 4/2020 Al-Mousa et al.
10,787,888 B2 9/2020 Andersen
10,837,254 B2 11/2020 Al-Mousa et al.
10,975,654 B1 4/2021 Neacsu et al.
10,982,504 B2 4/2021 Al-Mousa et al.
2002/0053428 A1 5/2002 Maples
2002/0060079 A1 5/2002 Metcalfe
2002/0195252 A1 12/2002 Maguire
2003/0047312 A1 3/2003 Bell
2003/0098064 A1 5/2003 Kohli et al.
2003/0132224 A1 7/2003 Spencer
2003/0150608 A1 8/2003 Smith
2003/0221840 A1 12/2003 Whitelaw
2004/0040707 A1 3/2004 Dusterhoft et al.
2004/0065446 A1 4/2004 Tran et al.
2004/0074819 A1 4/2004 Burnett
2004/0095248 A1 5/2004 Mandel
2004/0168796 A1 9/2004 Baugh et al.
2004/0216891 A1 11/2004 Maguire
2005/0024231 A1 2/2005 Fincher et al.
2005/0056427 A1 3/2005 Clemens et al.
2005/0087585 A1 4/2005 Copperthite et al.
2005/0167097 A1 8/2005 Sommers et al.
2005/0263282 A1 12/2005 Jeffrey et al.
2006/0082462 A1 4/2006 Crook
2006/0105896 A1 5/2006 Smith et al.
2006/0243453 A1 11/2006 McKee
2007/0114039 A1 5/2007 Hobdy et al.
2007/0137528 A1 6/2007 Le Roy-Delage et al.
2007/0181304 A1 8/2007 Rankin et al.
2007/0204999 A1 9/2007 Cowie et al.
2007/0256867 A1 11/2007 DeGeare et al.
2008/0007421 A1 1/2008 Liu et al.
2008/0087439 A1 4/2008 Dallas
2008/0236841 A1 10/2008 Howlett et al.
2008/0251253 A1 10/2008 Lumbye
2008/0314591 A1 12/2008 Hales et al.
2009/0194290 A1 8/2009 Parks et al.
2009/0250220 A1 10/2009 Stamoulis

(56) References Cited

U.S. PATENT DOCUMENTS

| | | | | |
|---|---|---|---|---|
| 2009/0308656 | A1 | 12/2009 | Chitwood | |
| 2010/0051265 | A1 | 3/2010 | Hurst | |
| 2010/0193124 | A1 | 8/2010 | Nicolas | |
| 2010/0258289 | A1 | 10/2010 | Lynde et al. | |
| 2010/0263856 | A1 | 10/2010 | Lynde et al. | |
| 2010/0270018 | A1 | 10/2010 | Howlett | |
| 2011/0036570 | A1 | 2/2011 | La Rovere et al. | |
| 2011/0056681 | A1 | 3/2011 | Khan | |
| 2011/0067869 | A1 | 3/2011 | Bour et al. | |
| 2011/0114389 | A1* | 5/2011 | Mathena | F23G 7/085 96/218 |
| 2011/0168411 | A1 | 7/2011 | Braddick | |
| 2011/0195364 | A1* | 8/2011 | Tullos | F23G 5/50 431/75 |
| 2011/0203794 | A1 | 8/2011 | Moffitt et al. | |
| 2011/0259609 | A1 | 10/2011 | Hessels et al. | |
| 2011/0273291 | A1 | 11/2011 | Adams | |
| 2011/0278021 | A1 | 11/2011 | Travis et al. | |
| 2012/0012335 | A1 | 1/2012 | White et al. | |
| 2012/0067447 | A1 | 3/2012 | Ryan et al. | |
| 2012/0085538 | A1 | 4/2012 | Guerrero | |
| 2012/0118571 | A1 | 5/2012 | Zhou | |
| 2012/0170406 | A1 | 7/2012 | DiFoggio et al. | |
| 2012/0285684 | A1 | 11/2012 | Crow et al. | |
| 2013/0062055 | A1 | 3/2013 | Tolman | |
| 2013/0134704 | A1 | 5/2013 | Klimack | |
| 2013/0213654 | A1 | 8/2013 | Dewey et al. | |
| 2013/0240207 | A1 | 9/2013 | Frazier | |
| 2013/0269097 | A1 | 10/2013 | Alammari | |
| 2013/0296199 | A1 | 11/2013 | Ghassemzadeh | |
| 2013/0299194 | A1 | 11/2013 | Bell | |
| 2014/0138091 | A1 | 5/2014 | Fuhst | |
| 2014/0158350 | A1 | 6/2014 | Castillo et al. | |
| 2014/0231068 | A1 | 8/2014 | Isaksen | |
| 2014/0251616 | A1 | 9/2014 | O'Rourke et al. | |
| 2015/0013994 | A1 | 1/2015 | Bailey et al. | |
| 2015/0096738 | A1 | 4/2015 | Atencio | |
| 2015/0152704 | A1 | 6/2015 | Tunget | |
| 2015/0260397 | A1* | 9/2015 | Talasila | F23N 5/022 431/14 |
| 2015/0275649 | A1 | 10/2015 | Orban | |
| 2015/0323177 | A1* | 11/2015 | Kovash | F23G 7/08 431/202 |
| 2016/0076327 | A1 | 3/2016 | Glaser et al. | |
| 2016/0084034 | A1 | 3/2016 | Roane et al. | |
| 2016/0130914 | A1 | 5/2016 | Steele | |
| 2016/0160106 | A1 | 6/2016 | Jamison et al. | |
| 2016/0237810 | A1 | 8/2016 | Beaman et al. | |
| 2016/0281458 | A1 | 9/2016 | Greenlee | |
| 2016/0305215 | A1 | 10/2016 | Harris et al. | |
| 2016/0340994 | A1 | 11/2016 | Ferguson et al. | |
| 2017/0044864 | A1 | 2/2017 | Sabins et al. | |
| 2017/0058628 | A1 | 3/2017 | Wijk et al. | |
| 2017/0067313 | A1 | 3/2017 | Connell et al. | |
| 2017/0089166 | A1 | 3/2017 | Sullivan | |
| 2018/0010418 | A1 | 1/2018 | VanLue | |
| 2018/0030809 | A1 | 2/2018 | Harestad et al. | |
| 2018/0058167 | A1 | 3/2018 | Finol et al. | |
| 2018/0187498 | A1 | 7/2018 | Soto et al. | |
| 2018/0209565 | A1 | 7/2018 | Lingnau | |
| 2018/0245427 | A1 | 8/2018 | Jimenez et al. | |
| 2018/0252069 | A1 | 9/2018 | Abdollah et al. | |
| 2019/0024473 | A1 | 1/2019 | Arefi | |
| 2019/0032792 | A1* | 1/2019 | Miller | F16K 1/42 |
| 2019/0049017 | A1 | 2/2019 | McAdam et al. | |
| 2019/0087548 | A1 | 3/2019 | Bennett et al. | |
| 2019/0186232 | A1 | 6/2019 | Ingram | |
| 2019/0203551 | A1 | 7/2019 | Davis et al. | |
| 2019/0242575 | A1* | 8/2019 | Fisher | F23G 7/085 |
| 2019/0284894 | A1 | 9/2019 | Schmidt et al. | |
| 2019/0284898 | A1 | 9/2019 | Fagna et al. | |
| 2019/0301258 | A1 | 10/2019 | Li | |
| 2019/0316424 | A1 | 10/2019 | Robichaux et al. | |
| 2019/0338615 | A1 | 11/2019 | Landry | |
| 2020/0032604 | A1 | 1/2020 | Al-Ramadhan | |
| 2020/0056446 | A1 | 2/2020 | Al-Mousa et al. | |
| 2020/0240225 | A1 | 7/2020 | King et al. | |
| 2021/0025259 | A1 | 1/2021 | Al-Mousa et al. | |
| 2021/0054696 | A1 | 2/2021 | Golinowski et al. | |
| 2021/0054706 | A1 | 2/2021 | Al-Mousa et al. | |
| 2021/0054708 | A1 | 2/2021 | Al-Mousa et al. | |
| 2021/0054710 | A1 | 2/2021 | Neacsu et al. | |
| 2021/0054716 | A1 | 2/2021 | Al-Mousa et al. | |

FOREIGN PATENT DOCUMENTS

| | | | |
|---|---|---|---|
| CA | 1329349 | | 5/1994 |
| CA | 2441138 | | 3/2004 |
| CA | 2762217 | | 5/2015 |
| CA | 2802988 | | 10/2015 |
| CA | 2879985 | | 4/2016 |
| CA | 2734032 | | 6/2016 |
| CN | 203292820 | | 11/2013 |
| CN | 103785923 | | 6/2016 |
| CN | 104712320 | | 12/2016 |
| CN | 107060679 | | 8/2017 |
| CN | 107191152 | | 9/2017 |
| CN | 107227939 | | 10/2017 |
| DK | 2545245 | | 4/2017 |
| DK | 2236742 | | 8/2017 |
| EP | 0792997 | | 1/1999 |
| EP | 2119867 | | 11/2009 |
| EP | 2309186 | | 4/2011 |
| EP | 2964874 | | 1/2016 |
| EP | 2545245 | | 4/2017 |
| GB | 958734 | | 5/1964 |
| GB | 2021178 | | 11/1979 |
| GB | 2392183 | | 2/2004 |
| GB | 2396634 | | 6/2004 |
| GB | 2414586 | | 11/2005 |
| GB | 2425138 | | 10/2006 |
| GB | 2453279 | | 1/2009 |
| GB | 2492663 | | 1/2014 |
| JP | 2009505013 | | 2/2009 |
| KR | 20190057181 | A * | 5/2019 |
| KR | 20190115662 | | 10/2019 |
| NO | 333538 | | 7/2013 |
| NO | 20170293 | | 8/2018 |
| OA | 5503 | | 4/1981 |
| WO | WO 1989012728 | | 12/1989 |
| WO | WO 1996039570 | | 12/1996 |
| WO | WO 2002090711 | | 11/2002 |
| WO | WO 2004046497 | | 6/2004 |
| WO | WO 2010132807 | | 11/2010 |
| WO | WO 2012161854 | | 11/2012 |
| WO | WO 2012164023 | | 12/2012 |
| WO | WO 2013109248 | | 7/2013 |
| WO | WO 2015112022 | | 7/2015 |
| WO | WO 2016011085 | | 1/2016 |
| WO | WO 2016040310 | | 3/2016 |
| WO | WO 2016140807 | | 9/2016 |
| WO | WO 2017043977 | | 3/2017 |
| WO | WO 2018017104 | | 1/2018 |
| WO | WO 2018164680 | | 9/2018 |
| WO | WO 2019027830 | | 2/2019 |
| WO | WO 2019132877 | | 7/2019 |
| WO | WO 2019231679 | | 12/2019 |

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.

Al-Ibrahim et al., "Automated Cyclostratigraphic Analysis in Carbonate Mudrocks Using Borehole Images," Article #41425, presented at the 2014 AAPG Annual Convention and Exhibition, Search and Discovery, Apr. 6-9, 2014, 4 pages.

Ashcor "Flame Smart EI+," Burner Management Systems, <https://ashcor.com/products/flame-smart-bms/>, 2020, 2 pages.

Bautista et al., "Probability-based Dynamic Time Warping for Gesture Recognition on RGB-D data," WDIA 2012: Advances in

(56) References Cited

OTHER PUBLICATIONS

Depth Image Analysis and Application, 126-135, International Workshop on Depth Image Analysis and Applications, 2012, 11 pages.
Boriah et al., "Similarity Measures for Categorical Data: A Comparative Evaluation," presented at the SIAM International Conference on Data Mining, SDM 2008, Apr. 24-26, 2008, 12 pages.
Bruton et al., "Whipstock Options for Sidetracking," Oilfield Review, Spring 2014, 26:1, 10 pages.
Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.
Edwards, "Construction de modèles stratigraphiques à partir de données éparses," Stratigraphie, Université de Lorraine, 2017, 133 pages, English abstract.
Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.
Forum Energy Technologies "Drill Pipe Float Valves," 2019, Catalog, 6 pages.
Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.
Herrera and Bann, "Guided seismic-to-well tying based on dynamic time warping," SEG Las Vegas 2012 Annual Meeting, Nov. 2012, 6 pages.
Hydril "Checkguard" Kellyguard Drill Stem Valves, Catalog DSV 2003, Brochure, 9 pages.
Keogh and Ratanamahatana, "Exact indexing of dynamic time warping," Knowledge and Information Systems, Springer-Verlag London Ltd., 2004, 29 pages.
Kurz Instruments Inc., "Saudi Aramco Used Kurz to Help Monitor Flare Emissions," available on or before Feb. 18, 2021, retrieved from URL <https://www.bing.com/search?q=http%3A%2F%2Fwww.kurzinstruments.com%2Fdownloads%2Fblog%2Fsaudi-aramco-uses-kurz-to-help-monitor-flare-emissions.pdf&qs=n&form=QBRE&msbsrank=7_7__0&sp=-1&pq=google&sc=7-6&sk=&cvid=3576A0E28A154B65BB8BDBF5B1BFCF69>, 6 pages.
Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.
Lallier et al., "Management of ambiguities in magnetostratigraphic correlation," Earth and Planetary Science Letters, 2013, 371-372: 26-36, 11 pages.
Lallier et al., "Uncertainty assessment in the stratigraphic well correlation of a carbonate ramp: Method and application of the Beausset Basin, SE France," C. R. Geoscience, 2016, 348: 499-509, 11 pages.
Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.
Nakanishi and Nakagawa, "Speaker-Independent Word Recognition by Less Cost and Stochastic Dynamic Time Warping Method," ISCA Archive, European Conference on Speech Technology, Sep. 1987, 4 pages.
packardusa.com [online], "Drop-in Check Valves," Packard International, available on or before Jul. 6, 2007, via Internet Archive: Wayback Machine URL <http://web.archive.org/web/20070706210423/http://packardusa.com/productsandservices5.asp>, retrieved on May 11, 2021, URL <www.packardusa.com/productsandservices5.asp>, 2 pages.
Panametrics, "Intrumentation for real-time flare system control," Baker Hughes Company <https://www.bakerhughesds.com/panametrics/flare-instrumentation>, 2021, 6 pages.
Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.
Pollack et al., "Automatic Well Log Correlation," AAPG Annual Convention and Exhibition, Apr. 3, 2017, 1 page, Abstract Only.
Rudman and Lankston, "Stratigraphic Correlation of Well Logs by Computer Techniques," The American Association of Petroleum Geologists, Mar. 1973, 53:3 (557-588), 12 pages.
Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.
Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.
Sayhi, "peakdet: Peak detection using MATLAB," Jul. 2012, 4 pages.
Scribd.com [online], "Milling Practices and Procedures," retrieved from URL <https://www.scribd.com/document/358420338/Milling-Rev-2-Secured>, 80 pages.
Silva and Koegh, "Prefix and Suffix Invariant Dynamic Time Warping," IEEE Computer Society, presented at the IEEE 16th International Conference on Data Mining, 2016, 6 pages.
Smith and Waterman, "New Stratigraphic Correlation Techniques," Journal of Geology, 1980, 88: 451-457, 8 pages.
Startzman and Kuo, "A Rule-Based System for Well Log Correlation," SPE Formative Evaluation, Society of Petroleum Engineers (SPE), Sep. 1987, 9 pages.
TAM International Inflatable and Swellable Packers, "TAM Scab Liner brochure," Tam International, available on or before Nov. 15, 2016, 4 pages.
Tomasi et al., "Correlation optimized warping and dynamic time warping as preprocessing methods for chromatographic data," Journal of Chemometrics, 2004, 18: 231-241, 11 pages.
Uchida et al., "Non-Markovian Dynamic Time Warping," presented at the 21st International Conference on Pattern Recognition (ICPR), Nov. 11-15, 2012, 4 pages.
Waterman and Raymond, "The Match Game: New Stratigraphic Correlation Algorithms," Mathematical Geology, 1987, 19:2, 19 pages.
Weatherford, "Micro-Seal Isolation System-Bow (MSIS-B)," Weatherford Swellable Well Construction Products, Brochure, 2009-2011, 2 pages.
Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

* cited by examiner

106

106

400

FLARE CONTROL AT WELL SITES

TECHNICAL FIELD

This disclosure relates to flare equipment and control of flare systems including at oil and gas production sites.

BACKGROUND

A flare, also known as a gas flare or flare stack, is a gas combustion device that burns flammable gases for disposal of the gases. The flare may be employed at oil or gas extraction (production) sites including oil wells, gas wells, and oil and gas wells. The wells may be at onshore well sites or offshore well sites. Offshore well sites may include a platform or rig. Oil or gas extraction sites may include wells drilled in a subterranean formation for the exploration or production of crude oil or natural gas.

At the oil and/or gas extraction site, the flare may be utilized for production flaring in which some of the petroleum or hydrocarbon discharged from the well via the wellhead is burned by the flare during production of the petroleum or hydrocarbon. The hydrocarbon (e.g., petroleum) combusted during production flaring can include natural gas and liquid hydrocarbon (e.g., crude oil). In addition to production flaring, the flare may combust flammable gases (and liquid hydrocarbon) collected during startup, maintenance, testing, or abnormal operations at the well site. The flare may combust flammable gases (and liquid hydrocarbon) discharged from the well via the wellhead during flowback operations.

In industrial plants or facilities, such as petroleum refineries, chemical plants, and natural gas processing plants, a flare may burn flammable gas released by pressure relief valves during unplanned over-pressuring of plant equipment. The flare in such facilities may also combust flammable vent gases during plant startups, plant shutdowns, and other plant operations typically for relatively short periods.

Carbon dioxide is the primary greenhouse gas emitted through human activities. Carbon dioxide (CO2) may be generated in various facilities including industrial sites, oil and gas sites, chemical plants, and so forth. At such facilities, the reduction of generation of CO2 may reduce CO2 emissions at the facility and therefore decrease the CO2 footprint of the facility.

SUMMARY

An aspect relates to a method of flaring, including disposing a flare system having a flare at a well site including a wellhead and a wellbore. The wellbore is formed in a subterranean formation for production of crude oil or natural gas, or both, from the subterranean formation. The flare includes a flare stack and a flare tip. The method includes providing produced fluid including hydrocarbon from the wellhead to the flare stack and flowing the produced fluid through the flare stack to the flare tip. The flare tip includes a nozzle for discharge of the produced fluid from the flare tip. The method includes discharging the produced fluid from the flare tip. The discharging of the produced fluid involves flowing the produced fluid through a nozzle discharge opening of the flare tip nozzle to external to the flare tip. The method includes combusting the hydrocarbon of the produced fluid as discharged from the flare tip, and adjusting, via a control system, flow area of the nozzle discharge opening.

Another aspect relates to a flare system to be disposed at a well site for flaring at the well site, the wellsite including a wellhead and a wellbore formed in a subterranean formation for production of crude oil or natural gas, or both. The flare system to receive produced fluid including hydrocarbon from a wellhead for combustion of the hydrocarbon. The flare of the flare system includes a flare stack to receive the produced fluid and a flare tip including a nozzle having a nozzle discharge opening for discharge of the produced fluid from the flare tip. The flare tip is coupled to the flare stack to receive the produced fluid from the flare stack. The flare includes a hydraulic piston to adjust position of a choking ball to adjust flow area of the nozzle discharge opening. The flare system includes a hydraulic system including a hydraulic pump to provide hydraulic fluid to the hydraulic piston. The flare system includes a control system to direct operation of the hydraulic system to adjust the flow area of the nozzle discharge opening via the hydraulic piston and the choking ball.

The details of one or more implementations are set forth in the accompanying drawings and the description below. Other features and advantages will be apparent from the description and drawings, and from the claims.

DETAILED DESCRIPTION

Figure 1:
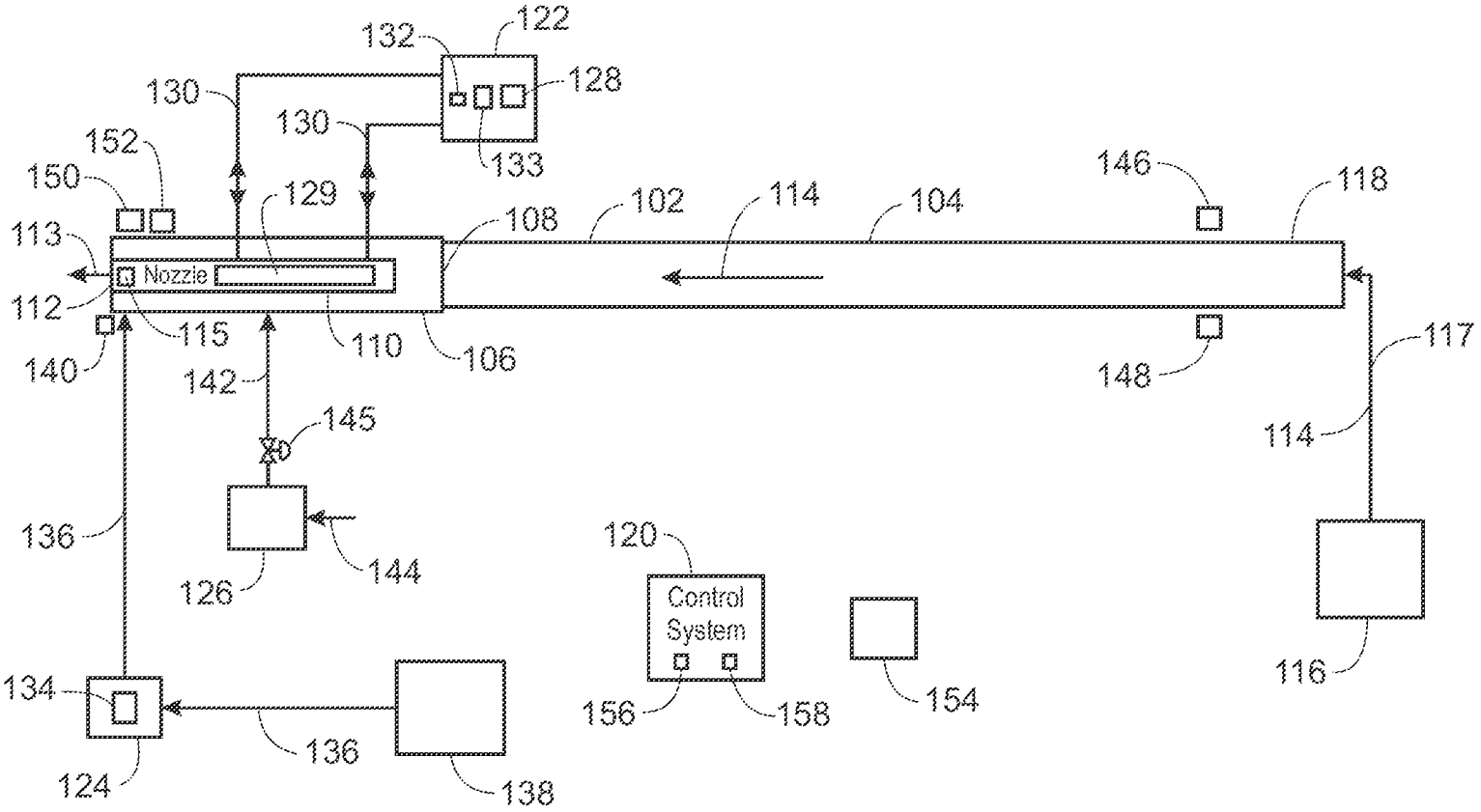
FIG. 1 is a diagram of a flare system disposed at a well site having a well with a wellbore formed in a subterranean formation.

Some aspects of the present disclose are directed to a flare system at a well site and in which the flare tip includes a remotely-adjustable nozzle. The flare of the flare system typically includes a flare stack and the flare tip. The flare stack receives produced fluid including hydrocarbon from the wellhead system. The flare tip discharges the produced fluid through the nozzle for combustion of the hydrocarbon. Beneficially, a control system may automatically adjust the nozzle discharge opening of the nozzle.

Embodiments of the present techniques may include a flare having a flare stack and a flare tip for flaring at a well site. The well site includes a wellhead and a wellbore for production of crude oil or natural gas, or both. The techniques may involve receiving produced fluid including hydrocarbon from the wellhead to the flare stack, discharging the produced fluid from the flare tip through a nozzle discharge opening, combusting the hydrocarbon of the produced fluid as discharged from the flare tip, and a control system adjusting flow area of the nozzle discharge opening.

Control of the flaring operation at oil and gas well sites can be challenging, especially over time, because flaring conditions may vary often and change rapidly. Therefore, adjustment of flare operating parameters may be implemented. Adjustments may be manual via user input by a human operator. However, some manual control can take time and may not be adequately responsive. Time consuming and inadequate manual control can result in negative environmental impact caused, for example, by poor combustion in the flaring, such as due to inadequate air in the mixture being burned or other reasons Furthermore, high-efficacy flare systems (including flare tips) may be designed and configured for flaring (combusting) gas with specific properties, such as composition, physical properties, flow rate, etc. Thus, unfortunately, the flexibility may be limited. In other words, the flaring in operation may be difficult to adjust to accommodate properties of the gas (to be combusted) beyond that initially specified. In contrast, flexibility and breadth of operation may be beneficial because each well may have a unique design basis affected by the oil and gas field development plan. The respective wells may behave differently including in regard to discharged fluids, operating patterns, and so forth.

For example, consider hypothetical well A and hypothetical well B having the same completions and producing from the same hydrocarbon reservoir, and conducting flaring during production. Well A produces crude oil having an American Petroleum Institute (API) gravity of 34 at 2500 barrels per day (bbl/day). Well B produces crude oil having an API gravity of 22 at 1800 bbl/day. Flare parameter values to achieve clean flaring may be different for well A versus well B. The configuring of a specific flaring system to accommodate both well A and well B may not be feasible without flexibility in the design or control. A flare designed for the conditions of well A may be problematic as applied to well B leading to undesirable effects. The undesirable effects may include, for example, poor flaring due to badly-controlled air supply, or flaring with high water content that can result in spreading unburned hydrocarbon by the produced flow or steam addition. Significant time and effort may be implemented under manual control to remedy the operation to give desirable clean flaring.

Embodiments herein provide for automatic control of flaring operation at oil and gas well sites including control over time and with well conditions or flare parameters that change. In some implementations, the flaring system may be labeled as an astute flaring system in having a control system that can automatically control the flare system and improve flaring operation. The improved operation may give clean flaring and reduce frequency of poor flaring. Poor flaring may be low air-content flaring, high water-content flaring, and so forth. Poor flaring can have a negative impact on the environment. Clean flaring may be a combination of (1) complete combustion (or substantially complete combustion) of hydrocarbon (e.g., including crude oil and/or gas) produced (sent) from the well to the flare, and (2) converting any associated liquid water (produced with the hydrocarbon) in the combusted mixture to steam. The clean combustion may involve maintaining the stoichiometric ratio of combusted components (e.g., air and hydrocarbon) at or approaching the ideal stoichiometric ratio for combustion.

The flare system can be controlled manually, such as partial or full manual operation (control) via a human operator. In implementations, the human operator may employ the control system to perform the manual operation. The manual operation can also involve manual adjustments in the field without use of a control system or centralized control system.

Embodiments of the present flare system can be operated automatically including essentially fully automatic. Such may be implemented by the control system.

Embodiments of the flare described herein may be a flexible system that can be set up in a relatively short time and cover wide range of flaring operations, including at oil and gas production well sites. In implementations, the flare or flare system may be relocated from one well site to another well site if desired.

Embodiments of the flare system with automatic control may give improved flaring as compared to manual control. The flare may include a flare tip nozzle (that is adjustable) for discharge of fluid to be combusted. As discussed below, examples of the flare system include a control system (or control module) that may adjust the flare tip nozzle having an automatic choke that is remotely controlled via the control system. This nozzle can be characterized or labeled as remotely-controlled nozzle or remotely-adjusted nozzle. The flare system can include a compressed air supply to add air to the produced fluid to be combusted. The compressed air supply can be directed (controlled) by the control system to give a desirable stoichiometric relationship between flammable components and air in the mixture being combusted.

The air supply pressure may be controlled by a pressure regulator. The pressure regulator may adjust the flow rate of the air supply to control the pressure of the air. The air supply pressure may controlled by a pressure regulator and the volumetric flow rate of the air supply controlled by a valve, such as a gate valve. The air supply pressure and volumetric flow rate may be adjusted based on the amount of air supply specified by the control system to maintain good quality of flaring.

The flare system can include an ignition system that can be directed (controlled) by the control system for igniting the fluid (e.g., mixture of produced fluid and air) discharged from the flare tip to be combusted. The ignition system may include a fuel pump directed by the control system to control the ignition fuel supply rate. The ignition system may include an igniter located at the flare-tip nozzle discharge. The igniter may be an electronic spark igniter that generates a spark (e.g., an electrical spark). The ignition may be controlled and set under (in response to) certain conditions. For example, if the flare flame weakens and flame temperature decreases, the control system may direct operation of the spark igniter and increase ignition fuel supply rate. In another example, if the control system receives feedback (e.g., data) from a gas sensor that the produced fluid from the wellhead system to the flare decreases in flammable components, such as due to an increase of water in the produced fluid, the control system can direct the fuel pump to increase the flow rate of the ignition fuel to promote that ignition and combustion (e.g., substantially complete combustion) of the flammable components in the produced fluid will occur.

In yet another example, if the control system receives feedback from a gas sensor that the produced fluid from the wellhead system to the flare increases in flammable components, the control system can direct the fuel pump to decrease the flow rate of the ignition fuel in response. In that example, the control system may also direct the air compressor (or associated control valve) to increase the air flow rate to the flare tip to maintain the molar ratio of air to flammable components at or above the stoichiometric relationship for combustion.

The flare system can include sensors that provide information (data) to the control system. The data provided by the sensors may facilitate the control system to control the ignition system, the air supply (e.g., pressure, flow rate, etc.), and the choke size of the flare nozzle. The control system may control the ignition system, adjust the air supply, and adjust (via adjustment of choking) the flare-tip nozzle size in response to the data received from the sensors and based on associated calculations performed by the control system. Examples of the parameter data provided from the sensors to the control system can include the flow rate of the produced fluid flowing through the flare stack, the temperature of the flare flame, the concentration of combustion products (of the flare combustion) in environment regions adjacent the flare flame, and so on. Gas components of interest in the environment near the flare flame may include, for example, nitrogen, carbon dioxide, carbon monoxide, hydrogen sulfide (H2S), and other components.

Lastly, while examples of operating adjustments by the control system are given, it can be appreciated that the control system may be programmed for operating adjustments that deviate from those described herein. After all, many parameters and operating variables of the flare system are involved in the flare system operation. The interactions between such parameters may affect decision making by the control system (or human operator) in making adjustments in the operation of the flare system. Advantageously, embodiments include a remotely-adjustable nozzle in the flare tip that can be the subject of operating adjustments.

FIG. 1 is a flare system 100 disposed at a well site having a well with a wellbore formed in a subterranean formation in the Earth crust. The wellbore may be formed in the subterranean for the production of crude oil or natural gas, or both, from the subterranean formation.

The flare system 100 includes a flare 102. The flare 102 is depicted as having a horizontal orientation but can instead have a vertical orientation or inclined orientation. The flare 102 includes a flare stack 104 and a flare tip 106. The flare stack 104 may be called a riser. The flare stack 104 and flare tip 106 may each be cylindrical conduit or conduit-like structure. The flare tip 106 is coupled to the flare stack 104, as indicated by reference numeral 108. The flare tip 106 can be coupled to the flare stack 104, for example, by a hammer union fitting or threaded connection.

The flow of produced fluid (for flaring) from the wellhead system to the flare 102 can be intermittent, e.g., sometimes there may be little or no produced fluid flowing from the wellhead to the flare 102. The flare system 100 may be capable to adapt to a wide range of flow rates of the produced fluid while maintaining the produced fluid mixture jetted at the flare nozzle 110, which can mean that the surface area of the combustion reaction is beneficially maintained at desired values.

The operating pressure of the flare stack 104 may be, for example, in the range of 2 pounds per square inch gauge (psig) to 200 psig, depending on the flare tip nozzle 110 size and on the amount of fluid discharge from the wellhead system to the flare 102. The rated pressure (a design rated maximum) of the flare stack 104 may be, for example, 500 psig or less. These numerical values for pressure are only given as examples and not intended to limit the present techniques.

The flare tip 106 has a nozzle 110 with an opening 112 (nozzle discharge opening) to discharge fluid 113 being combusted from the flare tip 106. The nozzle opening 112 may be labeled as the nozzle port. The nozzle opening 112 may be the discharge opening of the flare tip 106. The amount of cross-sectional area of the opening 112 available for flow of the fluid 113 may be called the flow area of the nozzle opening 112. This flow area is remotely adjustable via a remotely-adjustable positioning of a choking element 115 in the opening 112. Thus, a control system may automatically adjust the flow area of the nozzle opening 112. The choking element 115 may be, for example, a movable choking insert, a movable choking ball, a rotatable plate, and so on. In implementations, the choking element 115 may be driven by a hydraulic piston 129 (e.g., a dual-action hydraulic piston).

In operation, the nozzle 110 (nozzle opening 112) may be adjusted between open and closed. To open the nozzle 110 may mean to move (position) the choking element 115 to increase the flow area of the nozzle opening 112. To close the nozzle 110 may mean to move (position) the choking element 115 to reduce the flow area of the nozzle opening 112. The opening 112 may be remotely adjusted between open and closed via a control system automatically directing the choking element 115. In the open position, most of the cross-sectional area is unobstructed and thus available for flow the fluid 113, giving a larger flow area of the nozzle opening 112. In the partially closed position, most of the cross-sectional area is obstructed and thus not available for flow of the fluid 113, giving a smaller flow area of the nozzle opening 112. A range of opening percentages may be accommodated between the aforementioned open position and partially-closed position.

While the nozzle opening 112 may be a fixed size, the opening 112 size may be characterized as adjustable in that a portion of the opening 112 can be obstructed in operation of the nozzle 110. The operation may analogous to a flow control valve with the opening 112 analogous to a port, and in which nozzle 110 may be open or closed as with a control valve implementing different percent obstructions of the port. As indicated, the nozzle 110 may employ a choking element 115 (e.g., choking ball, choking insert, choking plate, etc.) to obstruct the opening 112.

The fluid 113 may be gas or liquid. The fluid 113 may include both gas and liquid. The liquid may include hydrocarbon and water. The fluid 113 may be labeled as a combustion zone fluid. The fluid 113 may include produced fluid (e.g., from the wellhead), air added to the flare tip 106, and any assist steam added to the flare tip 106. Fuel may be added at the flare tip 106 for ignition. In implementations, such fuel is generally not considered a component of the fluid 113 being combusted.

The flare 102 may receive produced fluid 114 from a wellhead 116 of a well having a wellbore, such as during production flaring or a flowback operation from the well or wellbore. Flowback operation may occur (1) when the well is initially opened, (2) during initial well cleanup and the early stage of production (e.g., of volatile hydrocarbon), and (3) to remove fluids introduced to the well. The produced fluid 114 can be or include production fluid (e.g., hydrocarbon and formation water), completion fluids, and drilling mud (drilling fluid) from the subterranean formation. The produced fluid 114 may be fluid discharged from the wellhead 116 system that is associated with cleaning or maintenance of the well and not with direct production from the subterranean formation. The produced fluid 114 may include gas and liquid. Various equipment associated with the wellhead 116 may discharge process fluid through subheaders into a flare header 117 that conveys the produced fluid 114 to the flare 102. Liquid in the produced fluid 114 may be flashed through the nozzle 110 into gas or vapor and then ignited.

The processing of a relatively large amount of liquid into the flare 102 can occur, for example, during certain flowback operations that remove unwanted fluid that was introduced (e.g., in drilling) into the subterranean formation. This may be in contrast to other types of flare systems, such as at petrochemical plants or petroleum refineries, in which conventional flaring is mostly associated with gas.

A three-phase separator (e.g., horizontal or vertical orientation) may be employed at the wellhead 116 to separate produced well fluid into gas, oil, and water phases. In certain implementations, a knock-out drum (also called knock-out pot) that is a vessel downstream of the separator may be disposed along the flare header 117 transporting the produced fluid 114 to the flare stack 104. A knock-out drum may recover liquid (e.g., typically water) from the produced fluid 114. A knock-out drum may be common for a flare system in a petrochemical plant or refinery. However, at a well site (e.g., an oil well at a remote area), a knock-out drum may be only strategically employed if there is high-water content in the produced fluid 114, such as with problematic operation of the upstream three-phase separator or other reasons.

In implementations, a knock-out drum is not included or can be bypassed because it may be desired to send the produced fluid 114 as liquid or including liquid to the flare 102. For instance, in a flowback operation for cleaning a new well where production lines are not yet available, the produced fluid 114 (e.g., including downstream of the aforementioned separator) may be primarily liquid that is sent to the flare 102. Such is different compared to a flare in petrochemical plant or refinery. Here, the present techniques may accommodate targeting flowback operations associated with new wells (or wells that had a recent workover) that require or benefit from a flowback of the well and in which production lines are not available. Flowback operations may be normally conducted for reservoir stimulation and removal of unwanted solids that were introduce by drilling fluids that might cause erosion to production line, and so forth. During this flowback, a production line may not be available, and transporting the produced oil offsite may not possible or feasible due to environmental or economic reasons.

The produced fluid 114 may enter the flare 102 at a base portion 118 (which may be labeled as an inlet portion) of the flare stack 104. The produced fluid 114 flows through the flare stack 104 into the flare tip 106. The produced fluid 114 discharges from the flare tip 106 through the nozzle opening 112 as part of the fluid 113 to be combusted. The nozzle opening 112 may be labeled as nozzle discharge opening 112. The fluid 113 discharged through the nozzle opening 112 to be combusted may include the produced fluid 114 and added air.

A control system 120 directs operation of the flare system 100 and can provide automatic control of the flare system 100. The control system 120 may automatically control equipment in the flare system 100 based on (or in response to) feedback (e.g., information, data, etc.) received from sensors in the flare system 100. The equipment in the flare system 100 that may be directed or controlled by the control system 120 include, for example, the nozzle 110 and associated hydraulic system 122, the ignition system 124 for igniting the gas discharged from the flare tip 106, and the air compressor 126 and associated air control valve.

The control system 120 can be a control panel (or control module) disposed locally (e.g., adjacent certain equipment of the flare system 100). In other implementations, the control system 120 may be disposed in a control room at the well site. The control system 120 may have a user interface in which a user (e.g., human operator, remote computing device, etc.) can input control constraints (e.g., threshold values, set points, targets, etc.) and also exert manual control of the flare system 100.

The flare system 100 includes a hydraulic system 122 to operate the nozzle 110. The hydraulic system 122 may include a hydraulic pump 128 that can be an air hydraulic pump or an electric hydraulic pump. The control system 120 may automatically direct the hydraulic system 122 and the hydraulic piston 129. The control system 120 may automatically direct the choking element 115 by automatically directing the hydraulic piston 129 via the hydraulic system 122. The hydraulic system 122 may include valve(s) 132 and reservoir vessel(s) 133 in addition to the pump 128 for provision of hydraulic fluid 130 to the hydraulic piston 129. The hydraulic system 122 may include a close line for flow of hydraulic fluid 130 to and from the hydraulic piston 129. The flow of hydraulic fluid 130 through the close line to the hydraulic position may provide for reducing the open percentage of the nozzle opening 112. The hydraulic system 122 may include an open line for flow of hydraulic fluid 130 to and from the hydraulic piston 129. The flow of hydraulic fluid 130 through the open line to the hydraulic position may provide for increasing the open percentage of the nozzle opening 112. The close line and open line can be considered components couple to (but not part of) the hydraulic system 122. The hydraulic system 122 or the control system 120 may include a controller to adjust the valve(s) 132 or pump 128 to provide for the desired amount of movement (e.g., stroke movement) of the piston rod in the hydraulic piston 129 to give the desired open percentage of the nozzle opening 112, such as via positioning of the choking element 115. In the illustrated embodiment, the hydraulic piston 129 is dual action and is employed in the nozzle 110 to move the choking element 115 of the nozzle 110 to adjust the available cross-sectional area of the nozzle opening 112 for flow, i.e., to adjust the flow area of the nozzle opening 112.

Thus, the hydraulic system 122 may provide hydraulic fluid 130 for piston operation to move the choking element 115 (e.g., choking ball). As indicated, hydraulic fluid 130 may flow to the hydraulic piston 129 through the close (closing) line to close the nozzle opening 112. Hydraulic fluid 130 may flow to the hydraulic piston 129 through an open (opening) line to open the nozzle opening 112. Again, the control system 120 may direct operation of valves 132 in the hydraulic system 122 to provide for flow of hydraulic fluid 130 to control the position of the choking element 115 in the nozzle 110. The hydraulic fluid 130 may be, for example, mineral oil. The hydraulic system 122 may include one or more reservoir vessels 133 to hold the hydraulic fluid. The hydraulic fluid 130 in being provided to the hydraulic piston 129 may flow from a reservoir vessel 133 to the nozzle hydraulic piston 129. Hydraulic fluid 130 may flow from the nozzle hydraulic piston 129 to a reservoir vessel 133.

The flare system 100 has an ignition system 124 that may include a fuel pump 134 and an igniter 140. The ignition system 124 may include a piping manifold to facilitate utilize different types (sources) of ignition fuel, add fuel flow capacity, and to provide for coupling to back-up fuel. The ignition system 124 may include controls that direct operation of the pump 134 and the igniter 140. The control system 120 may interface with controls of the ignition system 124 to direct or control operation of the ignition system 124 including the pump 134 and the igniter 140. In some implementations, the ignition system 124 itself has little or no controls, and the control system 120 directly controls the fuel pump 134 and the igniter 140.

The fuel pump 134 may be a positive displacement pump (e.g., diaphragm pump) or a centrifugal pump. In operation, the fuel pump 134 receives fuel 136 from a fuel source 138. The fuel source 138 may be, for example, a vessel holding a supply of the fuel 136. The fuel 136 may be, for example, butane, diesel, or natural gas. The fuel 136 may be gas or liquid. The fuel pump 134 discharges the fuel 136 through a conduit to the flare tip 106 discharge where the fuel 136 can promote ignition of the flammable components in the discharged fluid 113. In implementations, this ignition fuel 136 may be supplied through a separate nozzle that is positioned to ignite the flammable components in the fluid 113.

The fuel pump 134 may provide motive force for flow of the fuel 136 from the fuel source 138 to the flare tip 106. In implementations, the speed of the fuel pump 134 may be controlled (e.g., via the control system 120) to control the flow rate (e.g., mass flow rate or volume flow rate) of the fuel 136. The speed may be based on rotation (e.g., revolutions per minute) of the pump 134 or based on the number of pump strokes per time of the pump 134, and the like. In other implementations, a flow control valve disposed along a conduit conveying the fuel 136 may be utilized by the control system 120 to control the flow rate of the fuel 136.

The igniter 140 (also called ignitor) of the ignition system 124 may be disposed at the flare tip 106 to ignite gas that discharges from the nozzle opening 112. The ignition system 124 via the igniter 140 may provide an intermittent spark or flame front. The igniter 140 may be a spark generator that generates sparks across an electrode. The igniter 140 may utilize a capacitor. The generated sparks may ignite the ignition fuel to generate an ignition fuel to generate an ignition flame to ignite the discharged fluid 113. The generated sparks reach into the fluid 113 discharged from the flare tip 106 to ignite the fluid 113. As an alternative to spark generation, the igniter 140 may be a hot surface igniter with silicon carbide or silicon nitride. In some implementations, the igniter 140 may employ piezo ignition and thus have a piezoelectric element or utilize the principle of piezoelectricity. In alternate embodiments, the igniter 140 may be a pilot light (flame) that is continuous (generally always on) and that serves to light (ignite) the gas exiting the flare tip 106.

As discussed, the control system 120 may control the fuel pump 134 to give a flow rate of the fuel 136 to the flare tip 106, such as to near the igniter 140. The control system 120 may determine the desired flow rate of the fuel 136 and control the fuel pump 134 accordingly.

The control system 120 may detect produced fluid 114, such as via the flow sensor 148 or pressure sensor 146. In response, the control system 120 may start the flaring combustion operation by supplying fuel 136 (via the pump 134) and igniting (via the igniter 140) the fuel 136 and the produced fluid 114 (with any added air 142). In contrast, a flare system in a petrochemical plant or petroleum refinery facility typically does not rely on (1) a flow meter to determine whether to initiate flaring or (2) a command from a control system to start flaring combustion operation.

In FIG. 1, the control system 120 may confirm that combustion has been initiated, for example, by detecting the existence of the flare flame at or near the flare tip 106 discharge, such as via a fire sensor 152 that can be or include a temperature sensor. The control system 120 can record (store data of) the temperature reading at the flare tip 106 discharge. The control system 120 in response to this temperature data and other data, such as composition data from the gas sensor 150, may adjust nozzle 110 size or air 142 flow rate, and the like, to give good flaring combustion.

The control system 120 may adjust operation of the ignition system (fuel pump 134 and igniter 140) in response to the flammability of the produced fluid 114 and the presence of water in the produced fluid 114. If the produced fluid 114 is highly flammable and easily ignitable (a good scenario), then in response the control system 120 may reduce the fuel 136 supply rate (e.g., to no flow) and keep the igniter 140 (e.g., spark igniter) running. If the produced fluid 114 is low flammability or not easily ignitable and contains water, the control system 120 in response may then increase the fuel 136 supply rate to facilitate complete combustion of the produced fluid 114 and maintain high temperature (via the combustion) to evaporate the produced water in the produced fluid 114

The control system 120 may specify a set point of the fuel 136 flow rate generated (provided) by the fuel pump 134. The control system 120 may determine and specify the set point of the fuel 136 flow rate based on calculations performed by the control system 120. Thus, the adjustments of the fuel 136 flow rate by the control system 120 may be based on calculations implemented by the control system 120. The calculations may be to achieve satisfactory and economical ignition as ignition requirements may change based on conditions (e.g., flow rate, composition, etc.) of the produced fluid 114. Equations that can be utilized in the calculations are, for example, Bernoulli's modified equations. Stoichiometric relationships for combustion may be considered. Moreover, the control system 120 as programed (e.g., via executable code stored in memory) may perform calculations based on trial and error (e.g., at an early stage of operation at a well site) by starting with inputted values (e.g., air supply flow rate, ignition fuel flow rate) and specifying specific target values for certain parameters (e.g., $CO_2$ reading from gas sensor 150) and not exceeding limit values (e.g., pressure in the flare stack 104). Once targeted values (e.g., $CO_2$ reading from gas sensor 150) the control system 120 may reduce ignition fuel 136 and air 142 supply while maintaining targeted values for parameters.

The following hypothetical scenario is given as a non-limiting example regarding achieving desired ignition and combustion. Specified maximum values for this particular example: (1) maximum 5 part per million (ppm) $CO_2$ in the flared mixture (e.g., $CO_2$ content from the combustion of the fluid 113) in the environment around the flare flame; (2) maximum pressure in flare stack 104 of 100 psig; (3) maximum flow rate of fluid 113 through fully open nozzle 110 specified at 2000 bbls/day giving maximum pressure (acting as backpressure) in the flare 102 at 100 psig; and (4) available ignition fuel is 20 bbls of diesel. At the start of this hypothetical scenario, the control system 120 receives an indication from the flow sensor 148 that produced fluid 114 is flowing through the flare stack 104. In response, the control system 120 initiates the flaring (combustion) operation by starting the igniter 140 along with ignition fuel 136 rate of 1 bbl/hour and air 142 at 150 liters/second. The control system 120 receives a $CO_2$ reading of 9 ppm from the gas sensor 150. In response to this $CO_2$ reading exceeding the target of maximum 5 ppm $CO_2$, the control system 120 instructs the hydraulic system 122 to partially close the nozzle 110. Consequently, the pressure reading of the flare stack 104 (as measured by the pressure sensor 146 and sent to the control system 120) increases, reaching 70 psig, and the $CO_2$ reading from gas sensor 150 is 6 ppm. In response, the control system 120 further reduces the nozzle size (further closes the nozzle 110). The pressure in the flare stack 104 increases to 90 psig and the $CO_2$ reading from the gas sensor 150 decreases to 5 ppm and thus satisfies the maximum 5 ppm target. The control system 120 reduces ignition fuel 136 rate to 0.5 bbl/day to reduce fuel consumption and which may facilitate continuing to meet the maximum 5 ppm $CO_2$ target. The $CO_2$ reading from the gas sensor 150 remains stabilized at 5 ppm $CO_2$. Then, the control system 120 reduces air 142 supply flow rate while monitoring the flame temperature to track the performance and presence of the flare flame. Gases other than CO2 are also monitored via the gas sensor 150 and utilized by the control system 120 in the control of the flaring operation. The control system 120 may continue to adjust operation to not exceed the maximum 5 ppm CO2 target in the environment around the flare flame while maintain clean flaring. This hypothetical scenario is given only as an example and not meant to limit the present techniques.

The flare system 100 includes the air compressor 126 to provide air 142 (e.g., compressed air) to the flare tip 106. The air 142 may combine with the produced fluid 114 and the fuel 136 in the flare tip 106 to give the fuel 136 to be combusted by the flare 102. The air compressor 126 may be a mechanical compressor. The intake air to the compressor 126 may be ambient air 144 from the surrounding environment. In other implementations, the intake air may be facility plant air or instrument air at the facility provided via headers by an upstream compressor.

The compressed air 142 supplied to the flare tip 106 may facilitate the flaring combustion because burning relatively large amounts of a flammable mixture may benefit from the supply of air. Such combustion by the flare 102 with added air 142 may be labeled as air assisted. Again, the fluid 113 combusted may be a produced mixture including the produce fluid 114 plus the added air 142. The fluid 113 may be liquid or gas, or both (e.g., 50% gas and 50% liquid based on weight or volume)

The control system 120 may control operation of the air compressor 126 to control the flow rate (and pressure) of the air 142 supplied to the flare tip 106. The control system 120 may control operation of a control element (e.g., valve, baffle, etc.) at the suction of the air compressor 126 to control flow rate of the air 142. The control system 120 may control speed of the air compressor 126, such as via a variable speed drive, to control flow rate of the air 142.

The control system 120 may control operation of a control valve 145 disposed along the discharge conduit from the air compressor 126 to control the air 142 supplied to the flare tip 106. The control valve 145 may be a flow control valve that controls flow rate of the air 142. The control valve 145 may be a pressure control valve (e.g., pressure regulator) that controls pressure of the air 142 (and thus adjusts flow rate of the air 142). The control system 120 can determine and input data to the controller of the control valve 145. The control system 120 may determine and specify (input) the set point of the control valve 145.

If the fluid 113 being combusted is lean in air and thus resulting in lean flaring, the control system 120 may detect such, e.g., via input from the gas sensor 150 that measures composition of the environment around the flare flame. In response, the control system may send a command to the control valve 145 to allow more air 142 to the flare tip 106 until the fluid 113 is more completely burning. In implementations, the gas sensor 150 can measure carbon monoxide (CO), carbon dioxide (CO2), nitrogen (N2), sulfur dioxide (SO2), nitrogen oxides (NOx), or volatile organic compounds (VOCs), or any combinations thereof. The control system 120 can utilize such measurements to determine aspects of the flaring combustion including if lean flaring is occurring.

The term "lean flaring" as used herein means that the mixture (e.g., fluid 113) being combusted is lean in air. The term "rich flaring" can mean that the fluid 113 being combusted is rich in air (greater than the ideal stoichiometric amount of air for combustion). This terminology may be the opposite with respect to combustion nomenclature. In other words, while "lean flaring" means lean in air, "lean combustion" means excess air (in combustion art, a "lean" mixture is lean in fuel, which is the opposite for flaring nomenclature as used herein in which a "lean" mixture is lean in air). In lean flaring, the molar ratio of the air to the flammable components in the fluid 113 is below (e.g., significantly below) the ideal stoichiometric ratio for combustion. With respect to flare operation, lean burning or lean mixture burning as disclosed herein may refer to burning of a mixture having flammable components with insufficient air for complete burning of the flammable components at the flare. Lean flaring may be when the fluid being combusted is rich in flammable components. The flammable components may include process fluid components. Lean flaring may generally be when the amount of air in the fluid being combusted is less than the ideal stoichiometric ratio of air to flammable components for combustion (burning).

Again, the control system 120 can specify the set point (e.g., pressure or flow rate) of the control valve 145 (e.g., a pressure regulator) for the air 142 supply. As mentioned, the gas sensor 150 (e.g., a multi-gas detector) may measure combustion gases (products of the combustion) around the flare flame. In other words, the gas sensor 150 may measure gases from the flared (burned) mixture (smoke). The gas sensor 150 is typically external to the flare tip 106 to measure gases generated from the flared mixture (after burning). The control system 120 may utilize this data from the gas sensor 150 to determine (e.g., calculate, estimate, etc.) the relative amount of flammable components in the fluid 113 versus the amount of air in the fluid 113. The gas sensor 150 may send (e.g., via an instrument transmitter) an indication of the measurements to the control system 120. Based on the measurements, the control system 120 may calculate or estimate that the fluid 113 is lean in air. In other words, the control system 120 may calculate or estimate that the molar ratio of the air to the flammable components in the fluid 113 is below the ideal stoichiometric ratio for combustion. As discussed, such may give lean flaring. Therefore, in response to the calculations performed by the control system 120 based on the composition (e.g., concentrations of certain components) measured by the gas sensor 150, the control system 120 may increase the set point of the control valve 145 to increase the flow rate of air 142 to the flare tip 106. In implementations, the increase in air 142 flow rate may give a molar ratio of the air to the flammable components in the fluid 113 at or above the ideal stoichiometric ratio for combustion.

In embodiments, a user (e.g., human operator) may input into the control system 120 a constraint specifying the target molar ratio of air to flammable components in the fluid 113 being combusted. The control system 120 may adjust the air 142 flow rate (e.g., via the control valve 145 as a pressure regulator) to meet the target molar ratio input by the user. In some implementations, the target molar ratio input by the user may exceed the ideal stoichiometric ratio for combustion giving excess air so to avoid lean flaring.

The pressure sensor 146 may be disposed along the flare stack 104 to measure the pressure in the flare stack 104 including when the produced fluid 114 is flowing through the flare stack 104. In one example, the pressure sensor 146 includes a diaphragm and is a diaphragm-type sensor. An instrument transmitter (pressure transmitter) may communicate an indication of the pressure measured by the pressure sensor 146 to the control system 120. In implementations, the pressure sensor 146 may be disposed along the base portion 118 of the flare stack 104 so to be away from the flare flame at the flare tip 106. In examples, a pressure sensor may be disposed along the flare header 117 or on the flare tip to measure the pressure in the flare header 117 or flare tip, respectively. For a pressure sensor at the flare tip, the pressure sensor may be configured for (protected from) the heat of the flare flame.

The control system 120 may adjust, via the hydraulic system 122, the position of the nozzle choking element 115 in response to the measured value of the flare stack 104 pressure as measured by the pressure sensor 146. For example, if the flare stack 104 pressure as measured by the pressure sensor 146 exceeds a threshold value, the control system 120 may direct movement of the choking element 115 to open (further open) the nozzle 110, i.e., increase the flow area of the nozzle opening 112. Such may decrease the pressure drop across the across the nozzle opening 112 to decrease the flare stack 104 pressure and therefore decrease backpressure on the flare header 117 and wellhead 116 system.

The flow sensor 148 may be disposed along the flare stack 104 to measure flow rate (e.g., mass flow rate or volumetric flow rate) of the produced fluid 114 flowing through the flare stack 104. A flow sensor may instead (or in addition) be installed along the flare header 117 to measure flow rate of the produced fluid. The flow sensor 148 may be, for example, an ultrasonic flow meter or a thermal mass flow meter. An instrument transmitter (flow transmitter) may communicate an indication of the flow rate measured by the flow sensor 148 to the control system 120. In implementations, the flow sensor 148 may be disposed along the base portion 118 of the flare stack 104 so to be away from the flare flame at the flare tip 106.

As discussed, the gas sensor 150 may be disposed at the flare tip 106. In implementations, the gas sensor 150 may be external to the flare tip 106 and measures gases around the flare flame. In implementations, the gas sensor 150 may measure certain specified gas components and not all gas components in the area at the flare flame at the flare tip 106 discharge. The gas sensor 150 may measure concentration (e.g., ppm) of components or detect presence (without measuring concentration) of components. The gas sensor 150 may measure, for example, CO, CO2, N2, oxygen (O2), SO2, NOx, flammable components, combustible gases, hydrocarbons, VOCs, or steam, or any combinations thereof. The gas sensor 150 may be configured with an operation mechanism involving, for example, electrochemical, semiconductors, oxidation, catalytic, photoionization, infrared, and so forth. The gas sensor 150 may be selected or configured to target gas components that can indicate performance of the flaring operation. Gas components (from the flaring combustion) of particular interest may include, for example CO2, CO, and O2, and others. An instrument transmitter may be coupled to the gas sensor 150 to communicate an indication of the gas components as measured by the gas sensor 150 to the control system 120. The control system 120 may utilize such feedback in the control of the flare system 100.

The gas sensor 150 may be a gas detector that is an instrument device that detects the presence of gases or measures the concentration (e.g., in ppm) of gases. The gas detector may measure the gases in an open area or volume, such in an ambient atmosphere (e.g., in the environment around the flare flame) having flare combustion gases. While some gas detectors may be portable, the gas sensor 150 at the flare tip 106 may more generally be a fixed type detector. The gas sensor 150 may be, for example, a multi-gas detector or multi-gas monitor. In implementations, a multi-gas detector may have more than one gas sensor within the multi-gas detector device.

The gas sensor 150 may be placed in positions (e.g., above the flame or flare tip) beneficial for measuring the flare combustion gases (sometimes generally visible as smoke). Furthermore, multiple separate gas sensors 150 can be employed at (external to) the flare tip 106 at different positions to collectively provide for improved readings of the flare combustion gases. In one implementation, in order to improve readings of the gases, a ducted system having ducts (conduits such as a tube or passageway) with vacuum fan(s) can be utilized to route the flare smoke to the gas sensor 150 and to protect the gas sensor 150 from the high temperature of the flare flame.

A fire sensor 152 (or temperature sensor) may be disposed at the flare tip 106 to indicate presence or temperature of the flare flame resulting from the combustion of the fluid 113. The fire sensor 152 may be disposed external to the flare tip 106. In lieu of a fire sensor, a temperature sensor may be so disposed and in that case, a fire (flare flame) can be indicated via the temperature measurement by the temperature sensor. The fire sensor 152 (which can be or include a temperature sensor) may be disposed external to the flare tip 106 along the discharge portion of the flare tip 106. The fire sensor 152 may be positioned to sense the flare flame. In implementations, the value of the temperature at or near the flame of the burned mixture 113 as measured by the fire sensor 152 (or temperature sensor) may be sent (e.g., via an instrument transmitter) to the control system 120.

The control system 120 may utilize data from the fire sensor or temperature sensor. The temperature measurements may facilitate an operation program for the control system 120 to handle the flaring operation. The control system 120 may adjust operation of the flare system 100 in response to the data from the fire sensor or temperature sensor. For cases of the temperature sensor indicating an increase or decrease in the flare flame temperature, the control system 120 may adjust ignition fuel 136 supply rate and nozzle 110 size. The amount of reduction of the nozzle opening 112 size may be limited by the maximum allowable pressure of the flare system 100 including the air compressor 126, flare stack 104, flare tip 106, and flare line, and the like.

In response to the temperature values (as sensed) of the flare flame (or near the flare flame) decreasing or falling below a specified lower threshold value (for temperature), the control system 120 may increase the ignition fuel 136 supply flow rate and reduce nozzle 110 size (reduce the available flow area of the nozzle opening 112). In response to the temperature (as sensed) of the flare flame or near the flare increasing or rising above a specified upper threshold value, the control system 120 may decrease the ignition fuel 136 supply flow rate and increase nozzle 110 size. To increase the nozzle 110 size may mean to increase the percent open such as to increase the available flow area of the nozzle opening 112. The aforementioned specified lower threshold temperature value and upper threshold temperature value can be entered (e.g., as constraints) into the control system 120 by a user or human operator. Lastly, adjustments by the control system 120 in response to measure temperature at or near the flare flame may be associated with or constrained by (or altered) in view of data received by the control system 120 from other sensors, such as the gas sensor 150 and the pressure sensor 146.

An example of reliance on the temperature sensor (which can be the fire sensor 152 or a component of the fire sensor 152) is described in this following hypothetic operational scenario. In this scenario, after a time period of no flow of produced fluid 114, produced fluid 114 begins to flow through the flare header 117 to the flare stack 104 from the well (e.g., from the wellhead 116 system). In this hypothetical scenario, the produced fluid 114 includes 20 weight percent (wt %) of water. The control system 120 initiates flaring in response to detecting (via the flow sensor 148) flow of the produced fluid 114 through the flare stack 104. To initiate flaring, the control system 120 utilizes (directs) the spark igniter 140 and ignition fuel 136 supply if needed to establish flaring (combustion of flammable components in the produced fluid 114). Subsequently, a malfunction occurs in operation of surface equipment associated with the well or wellhead 116 system leading to an increase in water content of the produced fluid to 80 wt %. Consequently, in this example, the flare flame (combustion) is extinguished due to high amount of water. As a result, the control system 120 receives an indication of a low amount of combustion gases as measured by the gas sensor 150 because nothing is being flared. There is no combustion (the produced fluid 114 is not being flared). In certain implementations, the control system 120 without reliance on a temperature sensor could misconstrue the indication from the gas sensor 150 of a low amount of measured gases. In particular, the control system 120 could misinterpret that the amount of certain combustion gases being low (or none) as a false reading that the flaring operation (combustion) is good. However, the temperature sensor indicates low temperature values and thus the control system 120 determines that no flare flame exists (the flaring combustion has ceased). In response, the control system 120 beneficially sends a command to the fuel pump 134 in the ignition system to supply more ignition fuel 136 for ignition and to increase the flare temperature to the targeted value. The targeted value may depend on the composition and other properties of the produced mixture 114. The target values can be determined for different types of produced fluid 114 mixtures. The goal may be to facilitate that the produced flammable components (e.g., hydrocarbons) in the produced fluid 114 are flared (combusted) and associated water in the produced fluid 114 is vaporized without carrying any unburned hydrocarbons.

The fire sensor 152 may include a visual sensor, thermal sensor, or ultraviolet (UV) energy sensor to detect presence of a flame. The fire sensor 152 may include a temperature sensor to measure temperature to indicate presence of the flare flame. Moreover, the temperature may be correlated with an arbitrary (e.g., dimensionless) scale for flame intensity. The temperature sensor may be, for example, a thermocouple or a resistive temperature device (RTD). The fire sensor 152 may include an infrared sensor (or similar sensor) that can measure temperature and utilized to estimate thermal radiation intensity or heat intensity of the flare flame. The fire sensor may be or include a light intensity sensor (configured to withstand high temperature) to measure light intensity (e.g., luminous intensity, radiant intensity, etc.). The light intensity sensor may be configured to withstand high temperature and to account for effect of day light. An instrument transmitter may be coupled to the fire sensor 152 to communicate an indication of the presence, temperature, and intensity of the flare flame as sensed by the fire sensor 152 to the control system 120.

The measurement of the light intensity, thermal radiation intensity, or heat intensity emitted by the flare flames may be beneficial, for example, in cases in which a flare pit is not visible to the human operator. This intensity data can indicate swings in the performance of flaring, such as with a significant decrease in intensity values meaning that the flare flame is extinguished, or a significant increase in intensity meaning excessive combustion or excessively rapid combustion (which can be confirmed by the gas sensor 150). In certain implementations, the intensity sensor (e.g., light intensity sensor), if employed, is not utilized by the control system 120 for feedback to control the flare system 100 operation but instead provides display of data to the human operator (e.g., at a user interface of a control system). In another instance, the intensity readings can confirm that the temperature sensor is giving faulty readings.

The flare system 100 may include a power supply 154 that supplies electricity to the control system 120. The power supply 154 may also supply electricity for other equipment in the flare system 100. The power supply 154 may be a portable generator that generates electricity from fuel (e.g., gasoline). The power supply 154 may an electricity supply system at the well site. The power supply 154 may be an interface for a remote electrical grid, and so forth.

As discussed, the control system 120 may facilitate or direct operation of the flare system 100, such as in the operation of equipment and the supply or discharge of flow streams (including flow rate and pressure) and associated control valves. The control system 120 may receive data from sensors in the flare system. The control system 120 may perform calculations. The control system 120 may specify set points for control devices in the flare system. The control system 120 may be disposed in the field or remotely in a control room. The control system 120 may include control modules and apparatuses distributed in the field.

The control system 120 may include a processor 156 and memory 158 storing code (e.g., logic, instructions, etc.) executed by the processor 156 to perform calculations and direct operations of the flare system 100. The control system 120 may be or include one or more controllers. The processor 156 (hardware processor) may be one or more processors and each processor may have one or more cores. The hardware processor(s) may include a microprocessor, a central processing unit (CPU), a graphic processing unit (GPU), a controller card, circuit board, or other circuitry. The memory 158 may include volatile memory (e.g., cache and random access memory), nonvolatile memory (e.g., hard drive, solid-state drive, and read-only memory), and firmware. The control system 120 may include a desktop computer, laptop computer, computer server, programmable logic controller (PLC), distributed computing system (DSC), controllers, actuators, or control cards.

The control system 120 may receive user input that specifies the set points of control devices or other control components in the flare system 100. The control system 120 typically includes a user interface for a human to enter set points and other targets or constraints to the control system 120. In some implementations, the control system 120 may calculate or otherwise determine set points of control devices. The control system 120 may be communicatively coupled to a remote computing system that performs calculations and provides direction including values for set points. In operation, the control system 120 may facilitate processes of the flare system 100 including to direct operation of flare nozzle 110 at the flare tip 106, as discussed herein. Again, the control system 120 may receive user input or computer input that specifies the set points of control components in the system 100. The control system 120 may determine, calculate, and specify the set point of control devices. The determination can be based at least in part on the operating conditions of the system 100 including feedback information from sensors and transmitters, and the like.

Some implementations may include a control room that can be a center of activity, facilitating monitoring and control of the process or facility. The control room may contain a human machine interface (HMI), which is a computer, for example, that runs specialized software to provide a user-interface for the control system. The HMI may vary by vendor and present the user with a graphical version of the remote process. There may be multiple HMI consoles or workstations, with varying degrees of access to data. The control system 120 can be a component of the control system based in the control room. The control system 120 may also or instead employ local control (e.g., distributed controllers, local control panels, etc.) distributed in the system 100. The base portion of the control system 120 can be a control panel or control module disposed in the field.

Figure 2:
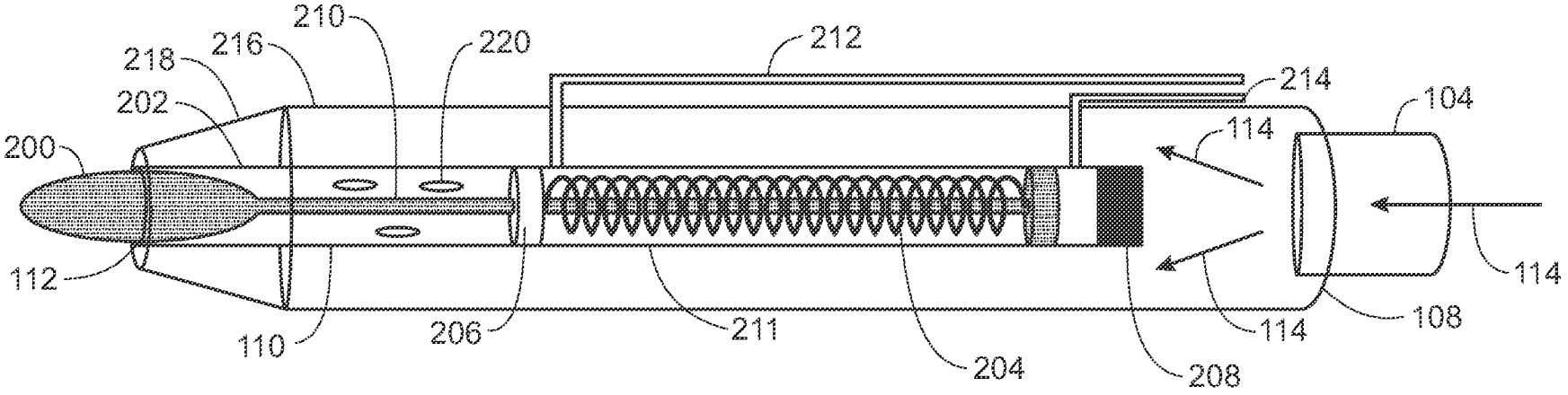
FIG. 2 is a diagram of an example of the flare tip of FIG. 1 with a nozzle in a substantially closed position and the flare tip depicted in perspective view with internals shown.

FIG. 2 is an example of the flare tip 106 (FIG. 1) depicted in perspective view with internals shown. The nozzle 110 is in a closed position (e.g., less than 10% open). The nozzle opening 112 is closed via placement of the choking ball 200 in the opening 112. The choking ball 200 may be analogous to the choking element 115 of FIG. 1. As discussed, the nozzle opening 112 is the flare tip 106 discharge opening. The nozzle 110 may be called a nozzle assembly. The nozzle 110 may be placed in a more open position (see FIG. 3) via movement of the choking ball 200.

The nozzle 110 has a cylindrical housing 202 (e.g., a conduit or shell) with the opening 112 (e.g., circular or cylindrical) at the flare tip 106 discharge. The nozzle 110 includes the choking ball 200 to obstruct cross-sectional surface area of the opening 112 to alter flow area to control (adjust, maintain, modulate) flow rate or pressure drop of the fluid 113 (see FIG. 1) that discharges through the opening 112 to be combusted. In the illustrated embodiment, the choking ball 200 has an oval or elliptical spheroid shape (a prolate spheroid). Other shapes of the choking ball 200 are applicable.

As indicated, fully closed may mean there is no flow area (0% flow area) of the opening 112. In other examples, fully closed may be defined to mean a minimum open percentage (e.g., 5% flow area). In implementations, the nozzle 110 is not configured to be fully closed at 0% flow area. In other words, the nozzle 110 is not configured to fully close (fully obstruct) the nozzle opening 112 that would give 0% flow area. For instance, the maximum diameter of the choking ball 200 may be less than the inside diameter of the opening 112 (and of the nozzle housing 202) such that at most 95% of the cross-sectional area of the opening 112 is obstructed by the choking ball 200 at the maximum closed position. Therefore, in that example at the maximum closed position, 5% of the cross-sectional area of the opening 112 is available for flow giving a 5% flow area meaning that the nozzle 110 is 5% open at the maximum closed position.

In implementations, the operating range for the nozzle 110 flow area (percent open) can depend, for example, on the maximum (peak) diameter of the choking ball 200, the nozzle opening 112 diameter, and the connection rod diameter 210. In one example, the operating range of the nozzle 110 is 5% open to 80% open. The shape of the choking ball 200 may be conducive to provide for a gradual change of the flow area in the opening 112 with only two movements of forward and backward (in the one-dimensional axial direction) of the choking ball 200 (via the hydraulic piston 204 with connection rod 210). The elliptical shape may provide a wide range of flow area while providing lower flow resistance.

In the illustrated example, the nozzle 110 incudes the hydraulic piston 204 having a spring (spring assembly). The hydraulic piston 204 may be analogous to the hydraulic piston 129 of FIG. 1. The hydraulic piston 204 is formed in the nozzle housing 202. Thus, the hydraulic piston 204 as a component of the nozzle 110 may share the nozzle outer housing 202. In this implementation, the hydraulic piston 204 is a duel-action hydraulic piston. In embodiments, the hydraulic piston 204 may be called a duel-action hydraulic positon with spring assembly. The hydraulic piston 204 includes a cylindrical cavity (within the housing 202) for hydraulic fluid. The cavity is defined by the piston lower limit 206 and the piston upper limit 208.

The choking ball 200 is coupled to the hydraulic piston 204 via a connection rod 210 (the piston rod). The piston head (e.g., a cylindrical plate or cylindrical block) is coupled to the opposite end of the connection rod 210. The piston head moves with the longitudinal (axial) movement of the connection rod 210. The piston head resides in the cavity 211 defined by the piston lower limit 206 and the piston upper limit 208.

The piston lower limit 206 is sealed. The piston lower limit 206 may be, for example, a cylindrical plate, cylindrical block, cylindrical plug, etc. The radial surface of the lower limit 206 contacts the inside diameter surface of the housing 202 to form a seal. The piston lower limit 206 may have an opening for the connection rod 210 and have an associated seal assembly such that hydraulic fluid does not escape from the cavity to beyond the lower limit 206 in the nozzle 110. The piston upper limit 208 is disposed at the closed end of the nozzle housing 202. The upper limit 208 may be an end plate of the housing 202. The upper limit 208 may be a cylindrical plate or plug inserted in the housing 202 and in which the radial surface of the upper limit 208 is disposed against the inside diameter surface of the housing 202. Thus, the piston upper limit 208 is sealed and may provide an abutment surface (stop) for the piston head.

The hydraulic system 122 (see FIG. 1) provides and receives hydraulic fluid 130 via a closing line 212 to the hydraulic piston 204 in the nozzle 110 to move the choking ball 200 toward the closed position, i.e., to reduce % open. The hydraulic system 122 provides and receives hydraulic fluid 130 via an opening line 214 to the hydraulic piston 204 to move the choking ball 200 toward the open position, i.e., to increase % open.

The flare tip 106 has an outer surface 216. In examples, the flare tip 106 may have a conical section 218 at the discharge portion of the flare tip 106. The flare tip 106 is coupled to the flare stack 104, as indicated at reference numeral 108. The flare stack 104 may be characterized as a flow line for the produced fluid 114. In operation, the produced fluid 114 (e.g., from the wellhead) flows through the flare stack 104 into the flare tip 106. As described with respect to FIG. 1, air 142 (and any steam) added to the flare tip 106 may join the produced fluid 114 in the flare tip 106 to give fluid 113 that is combusted. The fluid 113 to be combusted discharges from the flare tip 106 through the nozzle opening 112. In particular, the fluid 113 may flow from the annulus in the flare tip 106 around the nozzle 110 into the nozzle 110 through the flow ports 220 in the nozzle housing 202 and then flow to the nozzle opening 112. This flow of fluid 113 through (discharged from) the nozzle opening 112 will be at a lower (reduced) flow for the nozzle 110 as partially closed or reduced % open.

Figure 3:
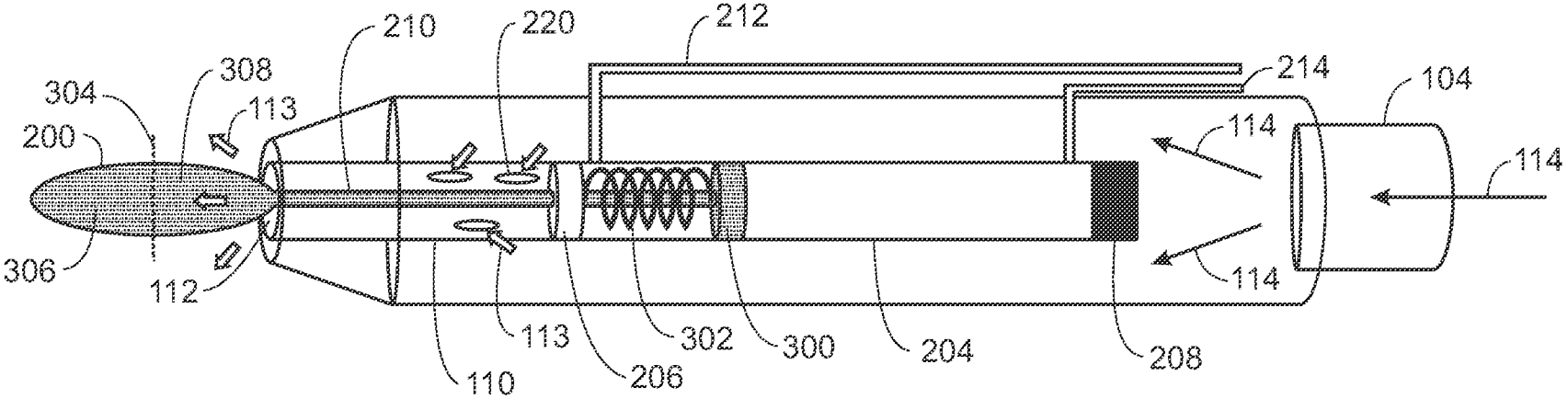
FIG. 3 is a diagram of the flare tip of FIG. 2 with the nozzle in a substantially open position.

FIG. 3 is the flare tip 106 of FIG. 1 but depicted with the nozzle 110 in a more open position (e.g., at least 80% open). The control system 120 (FIG. 1), via directing operation of the hydraulic system 122 and hydraulic piston, moves the choking ball 200 toward the outside of the nozzle 110 to give a more open position (increased flow area) of the nozzle opening 112. As discussed, the choking ball 200 may be utilized to partially plug the nozzle opening 112 (nozzle port) and control the flow area. The flow ports 220 are where the fluid 113 (including produced fluid 114 and any added air and/or steam) enters the nozzle 110 and flows to the opening 112.

As also discussed, a hydraulic piston 204 (e.g., duel-action hydraulic piston with spring assembly) may be employed in the nozzle 110. The duel action piston 204 may provide for adjusting the nozzle 110 size (e.g., adjusting the flow area of the nozzle opening 112) by movement of the connection rod 210 (and piston head 300). To implement the movement, the hydraulic piston 204 may utilized the supplied hydraulic fluid 130 (FIG. 1) from the close line 212 or from the open line 214. Thus, to adjust the flow area of the nozzle opening 112, the control system 120 may direct operation of the hydraulic system 122. The movement of the connection rod 210 (and piston head 300) is forward and backwards axially in one dimension (to the left and right on FIG. 3). Thus, the choking ball 200 is also so moved. The connection rod 210 may be the piston rod and having a rod portion coupling the choking ball 200 to the piston rod.

In implementations of operation of the hydraulic piston 204, hydraulic fluid 130 (FIG. 1) flows through the open line 214 to the hydraulic piston 204 to move the piston head 300, connection rod 210, and choking ball 200 to the left in FIG. 3. In this movement, the choking ball 200 is moved to external the nozzle 110 beyond the nozzle opening 112 to give a full open position, e.g., 80% open to 95% open, meaning that the flow area is 80% to 95% of the cross-sectional area of the opening 112.

Hydraulic fluid 130 (FIG. 1) flows through the close line 212 to the hydraulic piston 204 to move the piston head 300, connection rod 210, and choking ball 200 to the right in FIG. 3. The choking ball 200 is moved to at least partially inside the nozzle 110 to obstruct the nozzle opening 112 to approach a closed position. In one example, the fully closed position is specified at least 5% open, meaning that less than 95% of the cross-sectional area of the opening 112 is obstructed by the choking ball 200 (and therefore at least 5% of the cross-sectional area of the opening 112 is the flow area). The hydraulic piston 204 includes the spring 302 to facilitate the closing movement. The amount of travel of the rod 210 and head 300 in the piston 204 can be configured, for example, based on opening/closing size increments.

A reference line 304 is shown as dividing the choking ball into two equal halves: a left (or outside) half portion 306 and a right (or inside) half portion 308. In implementations, the left portion 306 is not involved in the obstruction of the nozzle opening 112 or in control of the flow area of the nozzle opening 112. In contrast, the right portion 308 is utilized to obstruct the nozzle opening 112 and thus is involved in the control of the flow area of the nozzle opening 112. In certain implementations, the choking ball 200 has the shape of a half of a prolate spheroid including only the right half 308 and not the left half 306. In those implementations, the left half 306 does not exist.

Again, the percent opening (% open) as stated may be based on the amount of cross-sectional surface of the opening 112 that is not obstructed. For instance, for the position of the choking ball 200 obstructing only 20% of the opening 112 cross-sectional area, the nozzle 110 may be considered 80% open. For the location of the choking ball 120 moved fully to outside of the opening 112, the connection rod 210 may obstruct, for example, 5% of the opening 112. Thus, in that example, the full open position of the nozzle 110 may be 95% open. In examples, the full open position of the nozzle 110 (and nozzle opening 112) may be in the range 80% open to 95% open.

The control system 120 (see FIG. 1) may automatically adjust the nozzle size, e.g., adjust the percent open (the flow area) of the nozzle opening 112, based on operational feedback received from sensors in the flare system 100. A remotely adjusted nozzle may be beneficial to maintain clean flaring including with respect to accommodating different produced flow rates of the produce fluid 114. For instance, for low flow rates of the produced fluid 114, the control system 120 may remotely adjust the nozzle 110 to decrease the flow area of the nozzle opening 112. Such may maintain a jetting action of the discharged fluid that is beneficial for combustion. For high flow rates of the produced fluid 114, the control system may remotely adjust the nozzle 110 to increase the flow area of the nozzle opening 112. Such may avoid flow characteristics (e.g., excessive jetting action) of the discharged fluid 113 unfavorable for combustion. The adjusted increase in flow area of the nozzle opening 112 in response to increased flow rate of the produced fluid 114 may also decrease pressure drop across the nozzle opening 112 and thus avoid a pressure increase in the flare 102 approaching the maximum rated pressure of the flare 102.

Clean flaring may mean a combination of (1) complete combustion (or substantially complete combustion) of the produced flammable components (e.g., hydrocarbons, such as crude oil and/or natural gas) in the produced fluid 114 and (2) converting any liquid water in the produced fluid to steam. Clean flaring may mean that a beneficial stoichiometric ratio (e.g., at or near the ideal ratio) of the combustion components in the fluid 113 being combusted is realized. Clean flaring may mean there is little or no unburned hydrocarbon. Clean flaring may mean there is little or no visible smoke (black or gray smoke).

In contrast to an adjustable nozzle, a fixed size nozzle may be utilized. However, the subsequent replacing the fixed size nozzle (with a fixed size nozzle having a large nozzle opening or with a fixed size nozzle having smaller nozzle) in response to changes in operating conditions (or for a different well) may require a substantial amount of time and expose the operator to the flare burner area.

Conversely, certain embodiments of the present remotely-adjustable nozzle 110 (e.g., hydraulically powered such as via a hydraulic system 122 having a hydraulic pump 128) can quickly and remotely change the nozzle opening 112 size and withstand high temperatures, as well as be subjected to automatic control by a control system 120. The control may be based on feedback from sensors in the flare system 100 regarding flare system 100 operating parameters. What is more, utilization of the remotely-adjustable nozzle may improve the burning of the produced mixture sent to the flare as the remotely-adjustable nozzle can be automatically adjusted quickly (e.g., nearly immediately such as less than 10 seconds) by the control system 120. For example, the control system 120 may remotely adjust the nozzle size (adjust the flow area of the nozzle opening 112) in response to changes in flow rate of the produced fluid 114, as discussed. The control system 120 may also be placed in manual control with respect to nozzle size so that a human operator can adjust the nozzle 110 size via the control system 120.

In embodiments, the nozzle discharge flow area may adjusted correlative with (e.g., directly proportional to) the flow rate of the produced fluid 114. For instance, if the supply flow rate of the produced fluid 114 decreases, the control system may direct the hydraulic system to move the choking ball such that the nozzle discharge flow area (nozzle opening flow area) is reduced. In implementations, to advance clean flaring (e.g., by increasing jetting action of the discharged fluid 113), if the produced fluid 114 decreases in flow rate from the wellhead 116 system, the nozzle 110 size (flow area of the opening 112) may be decreased automatically by the control system 120 or manually by a human operator via the control system 120. In implementations, to advance clean flaring and address pressure control in the flare 102, if the produced fluid 114 increases in flow rate from the wellhead 116 system, the nozzle 110 size (flow area of the opening 112) may be increased automatically by the control system 120 or manually by a human operator via the control system 120.

As indicated, the flow rate of the produced fluid 114 can be measured by a flow sensor (flow meter) installed on the upstream flare header 117 or on the flare stack, and the measured data sent from the flow meter to the control system. The flare stack may also be called a riser, flare line, or flare flow line. The flow rate data may be beneficial for the control system in detecting flow in the flare stack and also determining (calculating) an applicable flow area of the flare-tip nozzle opening.

As also indicated, the produced fluid 114 can include water. For increasing amounts of water in the produced fluid 114, the control system in response may increase the flow rate of the ignition fuel to the flare tip at the igniter. In some implementations, the high water content in the produced fluid 114 may be determined or estimated by measurement via the gas sensor of composition of the combustion gases, or noted by a fire sensor or visual sensor (e.g., camera) indicating high-water content flaring. In implementations, imaging processing of flare flame images captured by the camera may be utilized by the control system to determine the mixture being flare has high water content.

For excess amounts of water leading to problematic ignition, the control system 120 (see FIG. 1) may indicate an alert or alarm to a human operator. In response, the human operator can address, for example, upstream operation in the wellhead 116 system (see FIG. 1) that is discharging water to the flare.

The gas sensor (e.g., multi-gas detector, multi-gas composition meter, etc.) may provide data beneficial to evaluate the flaring operation. The gas sensor may gather the data to the send to the control system. The control system may have comparison data (gas composition emitted from the flaring combustion) loaded for each type of flaring mixture and decide if the flaring is satisfying (meeting) specified standards. The flaring mixture being combusted can include various combinations of all or some of water, gas (e.g., natural gas), oil (e.g., crude oil), oil-base mud (drilling fluid), base oils, completion fluids, workover fluids, and so on. The specified standards may be related to clean flaring, emissions (e.g., CO2), and other factors. If the flaring does not comply with the specified targets or standards, then the control system may take actions, such as to adjust nozzle size and/or alter the supply flow rate of ignition fuel. An example of a specified standard (target) is a maximum concentration (an upper threshold) of CO2 as measured in the flare combusted gas in the environment adjacent (e.g., to the sides or above) the flare flame. In implementations, specified values for the specified targets may be entered by a human operator into the control system 120.

The control system 120 (see FIG. 1) may be an integral component of the flare system. The control system may send commands to equipment in the flaring system to achieve or approach complete burn of the produced mixture from the wellhead system or from other systems at the well site. As discussed, the control system will include hardware and software. The software may include at least code stored in hardware memory 158. Hardware may include a signal receiver that receives data from the sensors, a processor 156 that executes stored code to analyze the data and send commands to the automatic nozzle choke, air supply, and ignition system. The hardware may include a signal-sending unit that sends the processed data to different components of the system. Software of the control system 120 can accommodate the burn reaction of crude oil and natural gas (and other burn reactions) and operate with self-learning (machine learning) with the combustion and associated control of the flare system. Software may facilitate processing of flow characteristics of the produced fluid 114 from the wellhead and of the fluid 113 mixture being combusted. The software may facilitate analysis of data and the sending of commands in response to different operating scenarios.

For example, if the produced fluid 114 (produced mixture) is 100% water, the control system 120 may stop the ignition system. However, if the produced fluid 114 includes gases, the control system may direct the ignition system to ignite or to continue to ignite. In another example, if the produced fluid 114 includes produced oil having a low API of 20, then the control system may direct the ignition system to give greater flow (volume) of ignition fuel (e.g., butane or diesel) for ignition. In particular, the control system may increase the flow rate from the fuel pump 134 in the ignition system or further open a control valve (e.g., butane gas valve) to supply more ignition fuel gas.

Flare system parameters directed or controlled by the control system 120 may include air supply (e.g., flow rate or pressure) to the flare tip 106, air 142, the adjustable nozzle size (as discussed) of the nozzle 110 in the flare tip, and the ignition fuel supply (e.g., flow rate of the fuel 136 supply) to the igniter at the flare tip.

The negative impact of high water content (e.g., great than 50 volume percent water) in the mixture (e.g., fluid 113 including produced fluid 114) being combusted by the flare may be incomplete combustion of hydrocarbon in the mixture giving unburned hydrocarbon (e.g., crude oil, natural gas, etc.) discharged to the environment. Unburned liquid hydrocarbon may discharge from the flare tip 106 to the ground. Thus, high water content can give poor flaring operation.

For flaring with high water content in the produced fluid 114 (and thus in the combusted fluid 113 that includes the produced fluid 114), the control system may direct the ignition system or the fuel pump of the ignition system to increase the flow rate (e.g., volumetric flow rate) of ignition fuel (e.g., butane or diesel) supplied by the fuel pump 134 to the flare tip 106 (e.g., to adjacent the igniter at the flare tip). Such may provide for more complete combustion of flammable components in the fluid 113. Such may mitigate (prevent or reduce) negative impact (e.g., incomplete combustion of hydrocarbons) of high water content on the flaring quality.

To give clean flaring when lean flaring is occurring, the control system 120 may adjust the nozzle 110 discharge flow area based on (in response to) the produced fluid 114 flow rate (e.g., as measured by the flow sensor on the flare stack). The nozzle discharge flow area may be adjusted based on the produced fluid 114 flow rate to maintain that the fluid 113

(including the produced fluid 114) be jetted at the flare tip discharge. The jetting action may reduce lean flaring by giving more surface area contact of the supplied air with the flammable components in the fluid 113 being combusted. Moreover, as discussed, a response to lean flaring may also be for the control system 120 to automatically increase the flow rate of air supplied to the flare tip 106 from the air compressor 126.

The flare 102 is generally configured to combust crude oil. In certain flowback operations of the well and with no available production lines, crude oil may discharge from the well (e.g., via the wellhead 116) to the flare 102 and be combusted. Other scenarios may provide crude oil to the flare 102 to be combusted.

In the context of the aforementioned hypothetical examples of well A and well B producing crude oil having different API gravity, the control system 120 may make adjustments to the flare system 100 as utilized sequentially in time for the two different wells. The flare system 100 (most or all of the equipment) may be relocated from one well to another well. As for the crude oil, higher API indicates a lighter (lower density) crude. Lower API indicates a heavier (more dense) crude. Heavy crude oil (low API gravity) may tend to exhibit slug flow and not readily or easily ignite.

For a decrease in API gravity of the crude oil that reaches the flare 102, the control system 120 in response may increase the supply flow rate of the ignition fuel and reduce the nozzle 110 size (reduce the flow area of the nozzle opening 112) to facilitate ignition and combustion. In other words, a reduction in the nozzle size will generally increase jetting of the produced fluid 114 (including the heavy oil) through the nozzle and thus may increase the surface area of the combustion reaction, which may advance ignition and combustion. As for lighter crude oil (high API gravity), in implementations, the flow rate of the ignition fuel 136 supply may be beneficially reduced because of the higher flammability of crude oil with high API gravity. Moreover, to improve ignition and combustion, the control system may alter the flow rate of the air 142 supply to the flare tip in response to measurements, for example, indicated from gas sensor and the temperature sensor.

Operating scenarios may include the control system 120 decreasing the nozzle size (e.g., adjusts the nozzle size smaller via the choking ball) in response to data received from sensors in the flare system. For example, the control system may direct the hydraulic system to move the choking ball via the hydraulic piston to reduce the flow area of the nozzle opening in response to the produced fluid 114 flow rate or pressure being low (e.g., below a threshold). The control system may receive data from the flow sensor (flow meter) on the flare stack and receive data from the pressure sensor on the flare stack. In response to the flow rate of the produced fluid 114 being low and/or the pressure in the flare stack being low, the control system may control the hydraulic system (e.g., control a valve in the hydraulic system) to move the choking ball in the direction that decreases the flow area of the nozzle opening. The control system may direct the adjustment to decrease the flow area, for example, by 10% of the cross-sectional area of the opening, such as decreasing the nozzle from 35% open to 25% open. Subsequently, the control system may increase or decrease the flow area of the nozzle opening based on the produced fluid 114 flow rate and flare stack pressure.

The control system 120 may decrease the flow area of the nozzle opening 112 (reduce % open) in response to composition data from a gas sensor at the flare tip indicating that incomplete combustion is occurring and in response to temperature data or visual data from a thermal sensor at the flare tip indicating that incomplete combustion is occurring. The decrease in flow area (decreasing the nozzle open %) may increase jetting action of the fluid 113 being discharged from the flare tip for combustion. An increased jetting action may be beneficial to advance combustion by increasing surface area of the combustion reaction (increase surface area of the contact of the reaction components) and make the discharged fluid 113 more conducive to ignition. For the occurrence of incomplete combustion or lean flaring, including with respect to inadequate jetting action of the discharged fluid 113, the control system in response may also direct the fuel pump or fuel control valve to increase the flow rate of the ignition fuel to the igniter area at the flare tip.

The aforementioned adjustments to decrease discharge flow area of the nozzle 110 may increase the pressure in the flare stack 104 because the reduced amount of cross-sectional area of the flare nozzle opening 112 available for flow may give a greater pressure drop across the flare nozzle. In addition, an increased flow rate of produced fluid 114 from the wellhead system may increase pressure in the flare stack. The control system 120 may monitor the flare stack pressure via the pressure sensor, and increase the nozzle flow area if the measured pressure of the flare stack reaches or exceeds a specified maximum threshold value for pressure in the flare stack or flare. The adjustment by the control system of the flow area of the nozzle opening may consider the maximum pressure specified for the flare stack and flare tip. A maximum pressure may be specified for the flare 102, for example, due to mechanical integrity of the flare, a maximum allowed threshold of backpressure on the upstream wellhead system, and a maximum allowed threshold of backpressure on the air compressor that supplies air to the flare tip, and so forth. For example, the air compressor may be rated at a design maximum pressure of 250-300 psig. Thus, the maximum allowed operating pressure (backpressure) in the flare tip 106 may be, for example, 250-300 psig. Thus, the control system may increase the flow area of the nozzle opening 112 in response to the flare stack pressure (e.g., as measured by the pressure sensor) exceeding a threshold and approaching the specified maximum pressure for the flare.

The control system 120 may direct the hydraulic system 122 to move the choking ball via the hydraulic piston 129 to decrease the flow area of the nozzle 110 opening 112 in response to the produced fluid 114 flow rate or pressure being low (e.g., below a threshold). The control system may direct the hydraulic system to move the choking ball via the hydraulic piston to decrease the flow area of the nozzle opening 112 to increase jetting action of the discharged fluid 113 in response to inadequate combustion. The control system may decrease the flow area of the nozzle opening 112 in response to combustion of the discharged fluid 113, e.g., as indicated by a gas sensor or temperature sensor, falling below a threshold (e.g., combustion of 95 wt % of the flammable components). The jetting action may increase the surface area of combustion reaction and therefore increase the percent combustion and also advance ignition of the fluid 113.

Lastly, while aspects of the present techniques may be applicable to flare systems at refineries, petrochemical plants, chemical plants, natural gas processing plants, or other facilities, certain embodiments of the present techniques are directed to flare systems at oil and gas well sites. There may significant differences in structural features and in application, as well as industry standards, for flaring at a well site versus in plant facility. Therefore, certain embodiments of the present flare system and flare (including the remotely-adjustable nozzle in the flare tip) are not a flare system at a refinery, petrochemical plant, chemical plant, natural gas processing plant, or other facility that is not an oil and/or gas well site. Some embodiments are only for flaring at an oil and/or gas well site.

Figure 4:
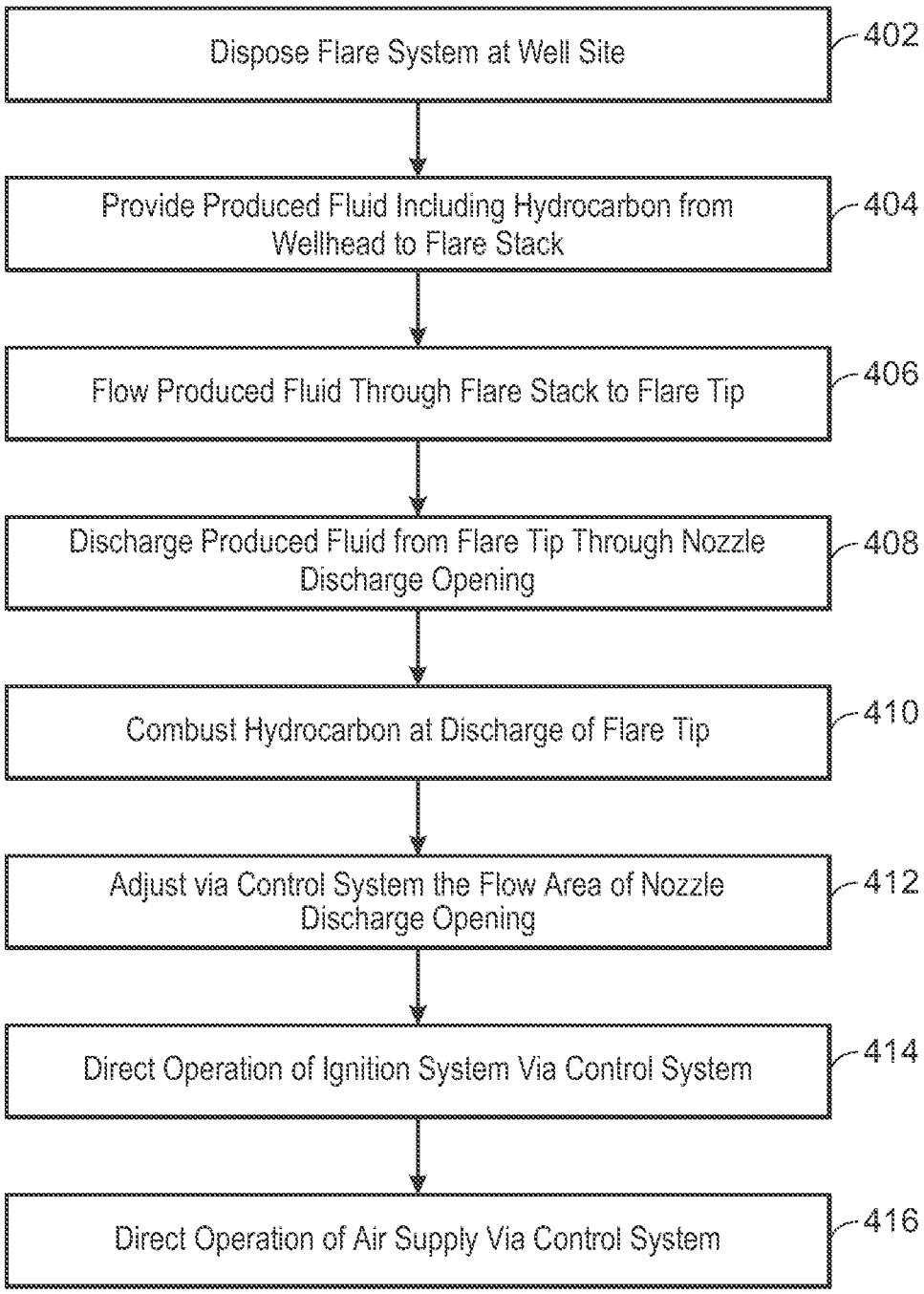
FIG. 4 is a block flow diagram of method of flaring performed by a flare system, such as at a well site.

FIG. 4 is a method 400 of flaring performed by a flare system, such as at a well site. The well may be an oil well, a gas well, or an oil and gas well. The flare system is for combustion of hydrocarbon in produced fluid provided from a wellhead to the flare. The flare tip may include an adjustable nozzle for discharge of the produced fluid from the flare tip. The flare system may include an ignition system having an igniter (and a fuel pump). The flare system may include an air compressor to supply air to the flare tip. In implementations, a control valve (e.g., pressure regulator) may be disposed along the discharge conduit (of the air compressor) conveying the air to the flare tip.

At block 402, the method includes disposing the flare system having the flare at a well site. The well site includes a wellhead and a wellbore. The wellbore is formed in a subterranean formation for production or exploration of crude oil or natural gas, or both, from the subterranean formation. The flare includes a flare stack and the flare tip.

At block 404, the method includes providing produced fluid including hydrocarbon from the wellhead to the flare stack. Thus, the produced fluid may be received at the flare stack from the wellhead. The produced fluid may be provided from the wellhead system. The produced fluid may be provided from equipment and systems associated with the wellhead. The providing of the produced fluid from the wellhead to the flare stack may involve flowing the produced fluid through a flare header.

At block 406, the method includes flowing the produced fluid through the flare stack to the flare tip. The flare tip includes a nozzle for discharge of the produced fluid from the flare tip.

At block 408, the method includes discharging the produced fluid from the flare tip, which involves flowing the produced fluid through a nozzle discharge opening of the nozzle to external to the flare tip. The discharging of the produced fluid from the flare tip may discharge the produced fluid from the flare.

At block 410, the method includes combusting the hydrocarbon of the produced fluid at or adjacent discharge of the produced fluid from the flare tip. The combusting of the hydrocarbon may be combusting the hydrocarbon via the flare system or flare. The hydrocarbon may include, for example, crude oil or natural gas, or both.

At block 412, the method includes adjusting, via a control system, flow area of the nozzle discharge opening. The adjusting may involve automatically adjusting the flow area via the control system in response to feedback (data) received from a sensor in the flare system. The adjusting of the flow area may involve the control system directing operation of the nozzle to adjust an amount of choking of the nozzle discharge opening. The adjusting of the flow area may involve the control system directing operation of the nozzle to position a choking element (e.g., choking ball) with respect to the nozzle discharge opening.

The adjusting of the flow area may include the control system adjusting an amount of choking of the nozzle discharge opening by directing operation of a hydraulic piston. The adjusting of the amount of choking may involve the control system directing operation of the hydraulic piston to position a choking ball in or through the nozzle discharge opening. Thus, the adjusting of the flow area may include the control system directing operation of a hydraulic piston to position a choking element with respect to the nozzle discharge opening. The hydraulic piston may be associated with the nozzle. The nozzle may include the hydraulic piston. In other words, the hydraulic piston may be a component of the nozzle. In implementations, the hydraulic piston may be a duel-action hydraulic piston. The adjusting of the flow area may include the control system directing a hydraulic system (having a hydraulic pump) to operate the hydraulic piston.

The adjusting of the flow area of the nozzle discharge opening may include automatically adjusting the flow area via the control system in response to flow rate of the produced fluid or in response to temperature of a flare flame associated with the combusting of the hydrocarbon, or a combination thereof. The adjusting may involve automatically adjusting the flow area via the control system in response to flow rate of the produced fluid flowing through the flare header or through the flare stack, or both. The adjusting may involve automatically adjusting the flow area via the control system in response to pressure in the flare header, pressure in the flare stack, or pressure in the flare tip, or any combinations thereof. The adjusting may involve automatically adjusting the flow area via the control system in response to composition of the fluid (e.g., including the produced fluid and added air) discharged from the flare tip.

At block 414, the method may include the control system directing operation of an ignition system having a fuel pump and an igniter for ignition of the hydrocarbon in the combusting of the hydrocarbon. The control system directing operation of the ignition system may involve the control system directing operation of the fuel pump to give a specified flow rate of fuel (ignition fuel) for ignition in response to data received from a sensor in the flare system.

At block 416, the method may include the control system directing operation of an air compressor or a pressure regulator, or both, to provide air to the flare tip. Such may involve adjusting flow rate or pressure of the air to the flare tip in response to feedback (data) from a sensor in the flare system. The air from the air compressor to the flare tip combines with the produced fluid in the flare tip and discharges with the produced fluid through the nozzle discharge opening from the flare tip.

An embodiment is a flare system to receive produced fluid including hydrocarbon from a wellhead for combustion of the hydrocarbon. The flare of the flare system includes a flare stack to receive the produced fluid from the wellhead, wherein the flare system to be disposed at a well site for flaring at the well site, the well site including the wellhead and a wellbore, the wellbore formed in a subterranean formation for production of crude oil or natural gas, or both. The flare incudes a flare tip having a nozzle including a nozzle discharge opening for discharge of the produced fluid from the flare tip, wherein the flare tip is coupled to the flare stack to receive the produced fluid from the flare stack. The flare system includes a hydraulic piston to adjust position of a choking ball to adjust flow area of the nozzle discharge opening. The flare system includes a hydraulic system including a hydraulic pump to provide hydraulic fluid to the hydraulic piston. The flare system includes a control system to direct operation of the hydraulic system to adjust the flow area of the nozzle discharge opening via the hydraulic piston and the choking ball. The choking ball may be coupled to the hydraulic piston via a connection rod. The nozzle may include the hydraulic piston. The hydraulic piston may be a dual-action hydraulic piston.

The flare system may include a sensor to measure an operating parameter of the flare system, wherein the control system to direct operation of the hydraulic system to adjust the flow area in response to measurement of the operating parameter by the sensor. The sensor may be or include a flow sensor (flow meter) disposed along the flare stack to measure flow rate of the produced fluid through the flare stack. Thus, the operating parameter is the flow rate of the produced fluid through the flare stack. The sensor may be or include a pressure sensor disposed along the flare stack to measure pressure in the flare stack, wherein the operating parameter is the pressure in the flare stack. The sensor may be a temperature sensor disposed at the flare tip to measure temperature of a flare flame resulting from combustion of the hydrocarbon, wherein the operating parameter is (or is correlative with) the temperature of the flare flame. The sensor may be a gas sensor to measure concentration of combustion gases in the environment around the flare flame at the flare tip discharge, wherein the operating parameter may be concentration of a gas component or a parameter derived from concentration of a combustion gas component.

The flare system may include an ignition system for combustion of the hydrocarbon. The ignition system may include a fuel pump to provide ignition fuel for ignition of the hydrocarbon in the produced fluid discharged from the flare tip for combustion of the hydrocarbon. The ignition system may include an igniter to provide an electrical spark for the ignition of the hydrocarbon in the produced fluid discharged from the flare tip for combustion of the hydrocarbon. The flare system may include an air compressor to supply air to the flare tip to combine with the produced fluid in the flare tip and discharge with the produced fluid from the flare tip through the nozzle discharge opening. The control system may be configured to control (direct operation of) the ignition system, the air compressor, or a control valve (e.g., pressure regulator) on the air supply, or any combinations thereof. Such control may be in response to feedback (data) received a sensor measuring an operating parameter in the flare system.

A number of implementations have been described. Nevertheless, it will be understood that various modifications may be made without departing from the spirit and scope of the disclosure.

What is claimed is:

1. A method of flaring, comprising:

disposing a flare system comprising a flare at a well site comprising a wellhead and a wellbore, the wellbore formed in a subterranean formation for production of crude oil or natural gas, or both, from the subterranean formation, wherein the flare system comprises a flare stack and a flare tip;

providing produced fluid comprising hydrocarbon from the wellhead to the flare stack;

flowing the produced fluid through the flare stack to the flare tip, the flare tip comprising a nozzle for discharge of the produced fluid from the flare tip;

providing air from an air compressor disposed external to the flare through a discharge conduit to the flare tip;

discharging the produced fluid and the air from the flare tip, wherein discharging comprises flowing the produced fluid and the air through a nozzle discharge opening of the nozzle to external to the flare tip, and wherein the air combines with the produced fluid in the flare tip and discharges with the produced fluid through the nozzle discharge opening from the flare tip;

combusting the hydrocarbon of the produced fluid as discharged from the flare via the flare tip; and adjusting, via a control system, the flow area of the nozzle discharge opening by positioning an elliptical ball in the nozzle discharge opening and moving at least a portion of the elliptical ball through the nozzle discharge opening to external of the flare tip.

2. The method of claim 1, wherein adjusting comprises adjusting automatically, via the control system, the flow area in response to feedback received from a sensor in the flare system, wherein the nozzle discharge opening is at an exit of the flare tip to external of the flare, wherein the air combined with the produced fluid discharges external to the flare at the nozzle discharge opening, and wherein combusting the hydrocarbon comprises combusting the hydrocarbon via the flare.

3. The method of claim 1, wherein adjusting comprises automatically adjusting, via the control system, the flow area in response to data received from a sensor in the flare system, wherein the flare system comprises an ignition system comprising an igniter, wherein the produced fluid comprises at least one of liquid water or the crude oil, and wherein discharging the produced fluid from the flare tip discharges the produced fluid from the flare.

4. The method of claim 1, comprising:

combining the air with the produced fluid in the flare tip in an annulus around a cylindrical housing of the nozzle to give a fluid comprising the produced fluid and the air; and flowing the fluid from the annulus through multiple ports on the cylindrical housing into the nozzle for discharge through the nozzle discharge opening, wherein adjusting the flow area comprises the control system directing operation of the nozzle to adjust an amount of choking of the nozzle discharge opening, wherein combusting the hydrocarbon comprises combusting the hydrocarbon via the flare system, wherein the hydrocarbon comprises crude oil or natural gas, or both.

5. The method of claim 1, comprising:

directing, via the control system, operation of the air compressor or a pressure regulator, or both, to provide the air to the flare tip; and directing, via the control system, operation of an ignition system comprising a fuel pump and an igniter for ignition of the hydrocarbon in the combusting of the hydrocarbon, wherein adjusting the flow area comprises directing, via the control system, operation of the nozzle to position the elliptical ball with respect to the nozzle discharge opening, and wherein directing the operation of the nozzle comprises directing operation of a hydraulic piston to position the choking element to adjust an amount of choking of the nozzle discharge opening.

6. The method of claim 5, wherein the nozzle comprises the hydraulic piston, and wherein directing, via the control system, operation of the ignition system comprises the control system directing operation of the fuel pump to give a specified flow rate of fuel for ignition in response to data received from a sensor in the flare system.

7. The method of claim 6, wherein adjusting the amount of choking comprises directing, via the control system, operation of the hydraulic piston to position the elliptical ball in and through the nozzle discharge opening, wherein directing, via the control system, operation of the air compressor or the pressure regulator, or both, comprises adjusting flow rate or pressure of the air provided to the flare tip in response to feedback from a sensor in the flare system, and wherein the pressure regulator is disposed along the discharge conduit.

8. The method of claim 1, wherein adjusting the flow area comprises the control system directing a hydraulic system comprising a hydraulic pump to operate a hydraulic piston associated with the nozzle, wherein the adjusting comprises positioning, via a hydraulic piston, the elliptical ball in the nozzle discharge opening, wherein at least half of the elliptical ball is situated external of the nozzle discharge opening downstream of the nozzle discharge opening, wherein the flare system comprises the air compressor to supply air to the flare tip, and wherein a pressure regulator that is a pressure control valve disposed along the discharge conduit.

9. The method of claim 1, wherein providing the produced fluid from the wellhead to the flare stack comprises flowing the produced fluid through a flare header, and wherein adjusting comprises automatically adjusting, via the control system, the flow area in response to flow rate of the produced fluid flowing through at least one of the flare header or through the flare stack, or in response to at least one of pressure in the flare header, pressure in the flare stack, or pressure in the flare tip, or any combinations thereof, and wherein the produced fluid comprises liquid water.

10. A flare system to receive produced fluid comprising hydrocarbon from a wellhead for combustion of the hydrocarbon, the flare system comprising:

a flare comprising:

a flare stack to receive the produced fluid, wherein the flare system to be disposed at a well site for flaring at the well site, the well site comprising the wellhead and a wellbore, the wellbore formed in a subterranean formation for production of crude oil or natural gas, or both, wherein the hydrocarbon comprises natural gas or crude oil, or both, and wherein the produced fluid comprises liquid comprising at least one of liquid water or the hydrocarbon including liquid crude oil;

a flare tip comprising a nozzle having a nozzle discharge opening for discharge of the produced fluid from the flare tip, wherein the flare tip is coupled to the flare stack to receive the produced fluid from the flare stack;

an elliptical choking ball positioned at the nozzle discharge opening, the elliptical choking ball configured to transition from a position in which the elliptical choking ball completely closes the nozzle discharge opening to a position in which the elliptical choking ball extends outside the flare tip external and downstream of the nozzle discharge opening and opens the nozzle discharge opening; and a hydraulic piston to adjust a position of the elliptical choking ball to adjust flow area of the nozzle discharge opening;

an air compressor external to the flare to supply air to the flare tip to combine with the produced fluid in the flare tip and discharge with the produced fluid through the nozzle discharge opening from the flare tip;

a hydraulic system comprising a hydraulic pump to provide hydraulic fluid to the hydraulic piston to operate the hydraulic piston;

a control system to direct operation of the hydraulic system to adjust the flow area via the hydraulic piston and the elliptical choking ball; and a sensor to measure an operating parameter of the flare system, wherein the control system is configured to direct operation of the hydraulic system to adjust the flow area in response to measurement of the operating parameter by the sensor.

11. The flare system of claim 10, wherein the sensor comprises a flow sensor disposed along the flare stack to measure flow rate of the produced fluid through the flare stack, and wherein the operating parameter comprises the flow rate of the produced fluid through the flare stack.

12. The flare system of claim 10, wherein the nozzle discharge opening is at an exit of the flare tip to external of the flare to discharge the air combined with the produced fluid to external of the flare at the nozzle discharge opening, wherein the sensor comprises a pressure sensor disposed along the flare stack to measure pressure in the flare stack, and wherein the operating parameter comprises the pressure in the flare stack.

13. The flare system of claim 10, wherein at least a portion of the elliptical choking ball is situated external of the nozzle discharge opening downstream of the nozzle discharge opening, wherein the sensor comprises a temperature sensor disposed at the flare tip external to the flare tip and configured to measure temperature of or adjacent a flare flame external of the flare resulting from combustion of the hydrocarbon external of the flare, and wherein the operating parameter comprises the temperature of or adjacent the flare flame.

14. The flare system of claim 10, wherein the nozzle comprises a cylindrical housing having multiple ports to receive the produced fluid and the air into the nozzle from an annulus in the flare tip for discharge of the produced fluid and the air through the nozzle discharge opening, wherein the annulus is around the cylindrical housing, wherein the elliptical choking ball is coupled to the hydraulic piston via a connection rod, wherein the nozzle comprises the hydraulic piston, and wherein the hydraulic piston comprises a dual-action hydraulic piston.

15. The flare system of claim 10, comprising an ignition system for combustion of the hydrocarbon, the ignition system comprising:

a fuel pump to provide ignition fuel for ignition of the hydrocarbon in the produced fluid discharged from the flare tip for combustion of the hydrocarbon; and an igniter to provide an electrical spark for the ignition of the hydrocarbon in the produced fluid discharged from the flare tip for combustion of the hydrocarbon, wherein the flare tip is configured to combine the air with the produced fluid in the flare tip for discharge with the produced fluid through the nozzle discharge opening from the flare tip, and wherein the nozzle is configured for at least a portion of the elliptical choking ball to be situated through the nozzle discharge opening to external of the nozzle discharge opening downstream of the nozzle discharge opening.

16. The flare system of claim 10, comprising a pressure regulator disposed along the discharge conduit, wherein the pressure regulator is associated with the air compressor, wherein the sensor comprises a gas sensor disposed at the flare tip to measure concentration of a gas component in an environment adjacent a flare flame resulting from the combustion of the hydrocarbon, and wherein the nozzle discharge opening is at an exit of the flare tip to external of the flare and comprises a discharge opening of the flare tip.

17. A method of flaring, comprising:

disposing a flare system comprising a flare at a well site comprising a wellhead and a wellbore, the wellbore formed in a subterranean formation for production of crude oil or natural gas, or both, from the subterranean formation, wherein the flare comprises a flare stack and a flare tip, the flare tip comprising a nozzle;

providing produced fluid comprising hydrocarbon from the wellhead to the flare stack and flowing the produced fluid through the flare stack to the flare tip;

providing air from an air compressor external to the flare through a discharge conduit to the flare tip;

combining the air and the produced fluid in the flare tip in an annulus around a housing of the nozzle to give a fluid comprising the air and the produced fluid;

flowing the fluid comprising the air and the produced fluid through multiple ports on the housing into the nozzle;

flowing the fluid in the nozzle through a nozzle discharge opening of the nozzle to discharge the fluid from the flare tip to external of the flare;

combusting the fluid as discharged via the flare tip; and adjusting, via a control system, flow area of the nozzle discharge opening by moving a choking element comprising an elliptical choking ball from a first position on the nozzle discharge opening in which the elliptical choking ball completely blocks the nozzle discharge opening and a second position downstream of and external to the nozzle discharge opening in which the elliptical choking ball permits flow through the nozzle discharge opening.

18. The method of claim 17, wherein the hydrocarbon comprises natural gas or crude oil, or both, wherein the produced fluid as provided from the wellhead and as discharged from the flare tip comprises liquid, wherein the liquid comprises at least one of liquid water or the crude oil.

19. The method of claim 17, wherein positioning the choking element with respect to the nozzle discharge opening comprises positioning the choking element in and through the nozzle discharge opening, wherein the produced fluid comprises at least one of liquid water or the crude oil.

20. The method of claim 17, wherein the housing comprises a cylindrical shape.

21. The method of claim 17, wherein a pressure regulator that is a pressure control valve is disposed along the discharge conduit, wherein adjusting the flow area comprises positioning at least a portion of the choking element through the nozzle discharge opening to external of the flare.

22. The method of claim 17, wherein the nozzle discharge opening is at a discharge opening of the flare tip to external of the flare, and wherein the fluid discharges external to the flare at the nozzle discharge opening.

* * * * *